US011179284B2

(12) United States Patent
Stocker et al.

(10) Patent No.: US 11,179,284 B2
(45) Date of Patent: Nov. 23, 2021

(54) MOVER DEVICE FOR PERSONS WITH REDUCED MOBILITY

(71) Applicants: Niklaus Emanuele Stocker, Camorino (CH); Antonio Gonçalves Sampaio, Stabio (CH)

(72) Inventors: Niklaus Emanuele Stocker, Camorino (CH); Antonio Gonçalves Sampaio, Stabio (CH)

( * ) Notice: Subject to any disclaimer, the term of this patent is extended or adjusted under 35 U.S.C. 154(b) by 146 days.

(21) Appl. No.: 16/463,610

(22) PCT Filed: Nov. 23, 2017

(86) PCT No.: PCT/IB2017/057354
§ 371 (c)(1),
(2) Date: May 23, 2019

(87) PCT Pub. No.: WO2018/096479
PCT Pub. Date: May 31, 2018

(65) Prior Publication Data

US 2020/0179202 A1 Jun. 11, 2020

(30) Foreign Application Priority Data

Nov. 25, 2016 (CH) ..... 01560/16
Nov. 25, 2016 (IT) ..... 102016000119875
(Continued)

(51) Int. Cl.
*A61G 7/10* (2006.01)
*A41D 13/12* (2006.01)
*A61G 7/053* (2006.01)

(52) U.S. Cl.
CPC ..... *A61G 7/1015* (2013.01); *A41D 13/1236* (2013.01); *A61G 7/0536* (2013.01);
(Continued)

(58) Field of Classification Search
CPC .... A41D 13/1236; A61G 7/0536; A61G 7/10; A61G 7/1003; A61G 7/1015;
(Continued)

(56) References Cited

U.S. PATENT DOCUMENTS 2,603,851 A 7/1952 Hawkins
4,903,355 A * 2/1990 Hickerson ..... A61G 7/10 5/83.1
(Continued)

FOREIGN PATENT DOCUMENTS

WO 2013/060152 A1 5/2013

OTHER PUBLICATIONS

International Search Report and Written Opinion for application PCT/IB2017/057354 dated Dec. 22, 2017, European Patent Office, Rijswijk, Netherlands.

*Primary Examiner* — David R Hare
*Assistant Examiner* — Alexis Felix Lopez
(74) *Attorney, Agent, or Firm* — Underwood & Associates, LLC

(57) ABSTRACT

A mover device for the body of persons with reduced mobility, suitable and configured for being positioned above an installation. The device comprises a frame and a motor-driven operating portion at least partially overhanging the installation, which comprises a plurality of support elements movable according to at least one degree of freedom and configured for at least partially supporting the weight of a person, for moving at least a respective part of the person's body with respect to the remaining parts of the body. The device also comprises at least one housing and gripping element to house and grip parts and/or joints of a body which can be engaged by a respective support element and configured for operating at least between a rest condition
(Continued)

wherein it can engage a part of a body and a grip condition wherein it engages a part of a body.

21 Claims, 13 Drawing Sheets

(30) Foreign Application Priority Data

May 31, 2017 (CH) ..... 00705/17
May 31, 2017 (IT) ..... 102017000059606

(52) U.S. Cl.
CPC ..... *A61G 7/1003* (2013.01); *A61G 7/1042* (2013.01); *A61G 7/1051* (2013.01); *A61G 7/1055* (2013.01); *A61G 7/1076* (2013.01); *A61G 2203/12* (2013.01)

(58) Field of Classification Search
CPC .. A61G 7/1019; A61G 7/1042; A61G 7/1041; A61G 7/1055; A61G 7/1076; A61G 2203/12
See application file for complete search history.

(56) References Cited

U.S. PATENT DOCUMENTS 4,935,975 A * 6/1990 Mahar ..... A41D 13/1263 5/81.1 T
5,337,908 A * 8/1994 Beck, Jr. ..... A61G 7/1015 104/126
5,406,658 A * 4/1995 Olkkonen ..... A61G 7/005 5/83.1
5,499,408 A * 3/1996 Nix ..... A61G 7/1015 5/83.1
5,685,033 A * 11/1997 Lavin ..... A61G 7/1017 5/81.1 R
5,708,993 A * 1/1998 Campbell ..... A61G 7/1019 177/144
5,809,591 A * 9/1998 Capaldi ..... A61G 7/1015 5/83.1
5,815,859 A * 10/1998 Lavin ..... A61G 7/1046 5/89.1
6,578,210 B2 * 6/2003 Erickson ..... A61F 5/3792 5/83.1
7,930,775 B2 * 4/2011 Kluckhuhn ..... A61G 7/1076 5/85.1
8,060,958 B1 * 11/2011 Hough ..... A61G 7/1017 5/83.1
8,555,432 B2 * 10/2013 Lavin ..... A61G 7/1051 5/81.1 T
8,784,284 B1 * 7/2014 Smith ..... A63B 21/0552 482/121
2008/0271242 A1 * 11/2008 Hjort ..... B66C 9/06 5/85.1
2010/0071129 A1 * 3/2010 Yokota ..... A61G 7/1015 5/83.1
2010/0115695 A1 * 5/2010 White ..... A61G 7/1074 5/81.1 R

* cited by examiner

FIG.7
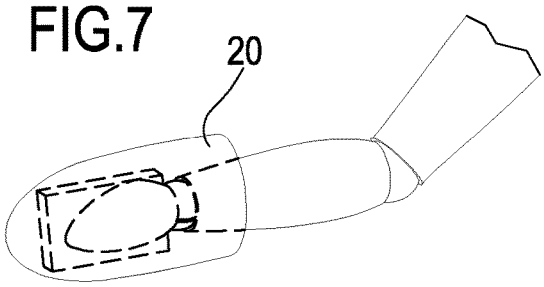
FIG.8
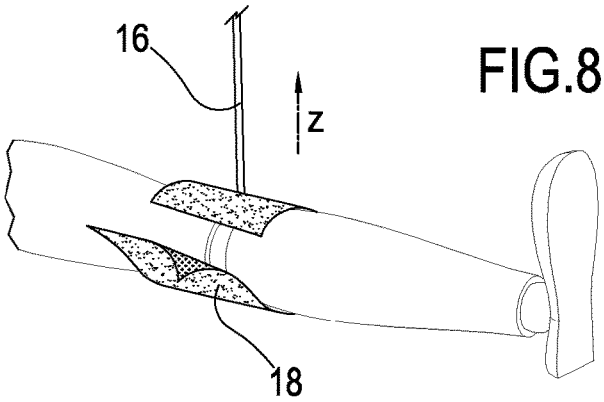
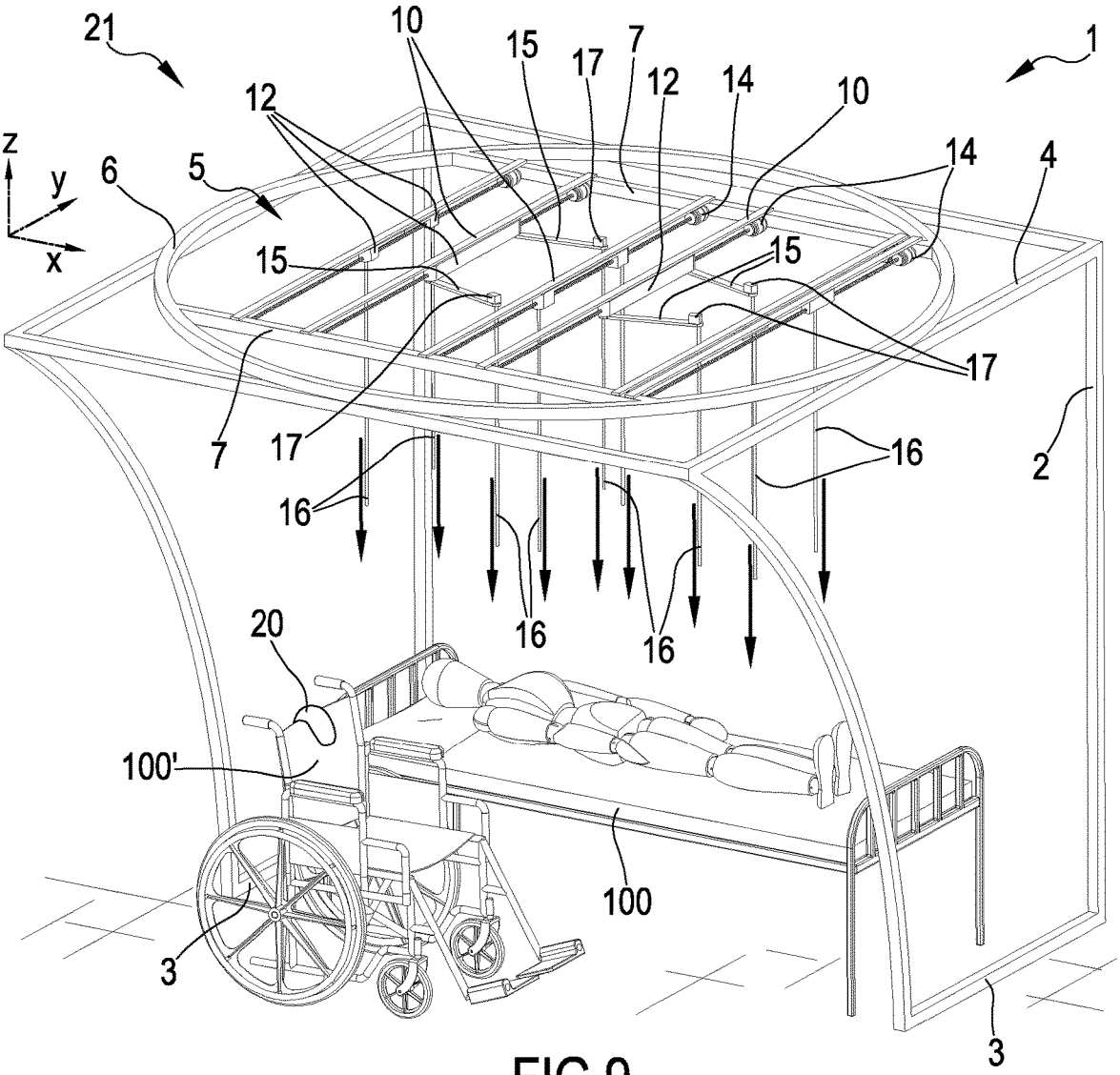
FIG.9

MOVER DEVICE FOR PERSONS WITH REDUCED MOBILITY

TECHNICAL FIELD OF THE INVENTION

The concepts herein relate to a mover device for persons with reduced mobility. The invention, which will be described below in details, can be implemented both in a medical-hospital environment, to assist elderly and disabled patients and/or persons with reduced mobility in general, and in a private environment, for instance in the house of a person with reduced mobility, just in order to assist and increase his/her own motor skills, by using the mover device according to this invention.

STATE OF THE ART

More or less complex devices and machines are known to assist persons with reduced mobility. A device of this kind is disclosed by patent document U.S. Pat. No. 6,213,435B1. The device here disclosed is substantially an auxiliary device conceived to help a patient with reduced mobility, for instance a bed ridden patient, in leaving the bed or in sitting up in bed. The auxiliary device comprises a holder which can be coupled with a bed frame by way of a fitting suitable for securing the holder itself to a side of the bed and a post coupled with the holder and adjustable in height. The upper end of the post is provided with two handles which are adjustable in height by raising or lowering the post and conceived for helping a patient to leave the bed or to sit up in bed. However, to be able to use such auxiliary device, a patient needs a residual mobility, at least in order to grip the handles as necessary to get up. Therefore, the device described in U.S. Pat. No. 6,213,435B1 is not a general-purpose one, i.e. it is not applicable to patients featuring strongly reduced mobility or totally devoid of mobility. Also, the presence of a nurse, assistant, or doctor is in any case necessary to prevent a patient from losing his/her balance and even falling down when gripping the handles. Therefore, the just described auxiliary device features many drawbacks.

Also in other known methodologies used to assist patients with reduced mobility, the presence of an assistant is always necessary to help a patient in his/her movements, for instance in laying down on bed, in sitting up in bed, in entering a bathtub or a shower, and in performing other movements that are potentially dangerous for a patient with reduced mobility.

In the light of the foregoing, it is therefore apparent that the known art as described above does not disclose any method or device that enables a patient to simultaneously move precisely, firmly, and effectively.

OBJECTS OF THE INVENTION

In the light of the foregoing, the concepts herein, which will be described in detail below, aim at providing a mover device easy to be assembled and a system reliable in its operation.

In certain instances, the concepts herein render users or patients with partially or totally reduced mobility independent from a constant presence and supervision of an assistant, nurse, or doctor.

In certain instances, the concepts herein provide a mover device and a procedure for moving patients that enables a patient to be moved safely, effectively, and precisely.

In certain instances, the concepts herein provide a mover device and a procedure for patients' movements capable of independently controlling the movements of a patient, or of individual parts of a patient's body, along the three axes.

These objects and others will become apparent in the present description and will be achieved by a mover device and a system in accordance with any of the attached claims and/or any of the following aspects.

SUMMARY OF THE INVENTION

In a 1st aspect, there is provided a mover device for the body of patients and/or persons with reduced mobility, suitable and configured for being operationally positioned above, or close to a health and/or medical and/or domestic and/or orthopaedic installation, be it movable or fixed, for instance a support, a bed, a seat, a shower and/or a bathtub, the mover device comprising:

- a frame comprising a binding portion configured for positioning said mover device in a stable equilibrium above or close to said health and/or medical and/or domestic and/or orthopaedic installation,
- a motor-driven operating portion, supported by said frame on an upper surface or portion of the frame and at least partially overhanging, or arranged close to said health and/or medical and/or domestic and/or orthopaedic installation, said motor-driven operating portion comprising a plurality of support elements, for instance cables, belts, or elongate traction elements, each support element being movable according to at least one degree of freedom and/or along at least one axis in the space.

In a 2nd aspect in accordance with the 1st aspect, each support element is configured for:

- at least partially or fully supporting the weight of a patient, and/or
- being moved, in particular translationally and/or rotationally, and/or
- moving at least one respective part of the patient's body according to said at least one degree of freedom and/or along said at least one axis with respect to said health and/or medical and/or domestic and/or orthopaedic installation.

In a 3rd aspect in accordance with the 1st or 2nd aspect, every support element is configured for moving parts of said patient's body to at least partially modify the position of a patient in the space and/or to make parts of the patient's body get closer to the health and/or medical and/or domestic and/or orthopaedic installation and/or to make them move away from the health and/or medical and/or domestic and/or orthopaedic installation.

In a 4th aspect in accordance with the 1st, 2nd, or 3rd aspect, the mover device comprises a plurality of fourth movers, preferably arranged, in particular, in correspondence with the motor-driven operating portion, each fourth mover being configured for moving a respective support element at least for vertical translation, and in particular in such a way as to get closer to the health and/or medical and/or domestic and/or orthopaedic installation and to move away from the health and/or medical and/or domestic and/or orthopaedic installation.

In a 5th aspect in accordance with the 4th aspect, each fourth mover comprises an electric motor, for instance a DC, stepping, or synchronous motor, and a pulley which is engaged with a respective support element, more particularly the support element is at least partially wound on the pulley.

In a 6th aspect in accordance with any of the aspects from the 1 st through 5th, the mover device also comprises a control unit configured for controlling and/or programming the movements of said support elements in order to make it possible to move, and in particular to at least lift and/or change the position of or to at least partially reposition parts of the patient's body or the patient himself with respect to said health and/or medical and/or domestic and/or orthopaedic installation, or with respect to a further health and/or medical and/or domestic and/or orthopaedic installation (for instance a wheelchair) arranged in proximity of said health and/or medical and/or domestic and/or orthopaedic installation.

In a 7th aspect in accordance with any of the aspects from 1st through 6th, every support element is movable in both directions (getting closer to and/or moving away from), preferably by way of a vertical translational movement, by getting closer to or moving away from said surface or upper portion of the frame towards the health and/or medical and/or domestic and/or orthopaedic installation in order to make it possible an appropriate positioning, for instance by way of a translation, rotation, and/or roto-translation of said at least one respective part of the patient's body.

In an 8th aspect in accordance with any of the aspects from 1st through 7th, the mover device also comprises an operating element, preferably shaped like a circumference or an ellipse, supported by the frame and configured at least to rotate about the frame in the same plane as said upper surface or portion of the frame or in a plane parallel to said upper surface or portion of the frame.

In a 9th aspect in accordance with the 8th aspect, the support elements are rotationally integral with each other and directly or indirectly engage said operating element to rotate integrally with the operating element.

In a 10th aspect in accordance with the 8th or 9th aspect, said operating element has one degree of freedom, said one degree of freedom being a rotation with respect to the frame, said rotation preferably taking place about an axis substantially vertical with respect to an upper surface or portion of said health and/or medical and/or domestic and/or orthopaedic installation.

In an 11th aspect in accordance with the 8th, 9th, or 10th aspect, the mover device comprises a first mover configured for driving said operating element into rotation.

In a 12th aspect in accordance with any of the aspects from 8th through 11th, the frame comprises a guide configured for allowing for the rotation of the operating element with respect to the frame itself.

In a 13th aspect in accordance with any of the aspects from the 8th through the 12th, the mover device comprises a first mover configured for driving the operating element into rotation.

In a 14th aspect in accordance with the 13th aspect, the first mover 8 is an electric motor, for instance a DC or stepping motor.

In a 15th aspect in accordance with the 13th or 14th aspect, the first mover is housed on board the operating element itself.

In a 16th aspect in accordance with the 13th, 14th, or 15th aspect, the first mover rotates integrally with the operating element.

In a 17th aspect in accordance with any of the 1st through 16th aspects, the mover device also comprises one or several cross-members, preferably supported by said operating element, each support cross-member featuring a main development direction and bearing at least one support element.

In an 18th aspect in accordance with the 17th aspect, at least one support element movably engages a respective support cross-member so that it can translate at least along the main development direction of said support cross-member.

In a 19th aspect in accordance with the 17th or 18th aspect, said one or several support cross-members engage said operating element by way of at least one guide rail or at least a pair of guide rails and are configured for moving translationally along said at least one guide rail or said at least one pair of guide rails.

In a 20th aspect in accordance with the 17th, 18th, or 19th aspect, said one or more upper cross-members are integral with the operating element upon rotation of the operating element.

In a 21st aspect in accordance with any of the 17th through 20th aspects, the mover device comprises an auxiliary mover, preferably arranged below with respect to the support cross-member(s), and an element suitable for being driven into rotation by the auxiliary mover, the auxiliary mover being configured for allowing for a translational movement of the support cross-member(s) transversally to its/their respective main development direction(s) of the support cross-member(s) itself(themselves).

In a 22nd aspect in accordance with the 21st aspect, the element features an elongated shape along a main development direction, which also operates as an axis of rotation of the element itself.

In a 23rd aspect in accordance with the aspects 21st or 22nd, the element comprises an endless screw directly operated by the auxiliary mover, or alternatively comprises an alternator belt system.

In a 24th aspect in accordance with any of the aspects from 17th through 23rd, the mover device comprises at least one intermediate connection element configured for operating as a connection between each individual support element and its respective support cross-member.

In a 25th aspect in accordance with any of the aspects from 17th through 24th, the mover device also comprises at least one swing arm, and in particular a pair of swing arms, mounted on a support cross-member, either directly or indirectly by way of an intermediate connection element slidable along said support cross-member, every swing arm bearing at least one respective support element and being configured for rotating and/or translationally moving with respect to said support cross-member.

In a 26th aspect in accordance with the 24th or 25th aspect, one or several support cross-members bear an intermediate connection element, said intermediate connection element bearing at least one support element and/or at least one swing arm.

In a 27th aspect in accordance with the 24th, 25th, or 26th aspect, said intermediate connection element is also configured for sliding along its respective support cross-member parallel to the main development direction of said support cross-member.

In a 28th aspect in accordance with the 16th or 27th aspect, the mover device comprises at least a third mover configured for allowing for said intermediate connection element to slide along its respective rotation bar, said at least one third mover being mounted on board a respective support cross-member being integral therewith in the translational movements of said support cross-member.

In a 29th aspect in accordance with the 28th aspect, the third mover is an electric motor, for instance a DC, stepping, or synchronous motor.

In a 30th aspect in accordance with any of the aspects from 25th through 29th, said at least one swing arm comprises at least one swivel arm, and in particular at least a pair of swivel arms, said at least one swivel arm comprising a first portion and a second portion, both featuring an elongate shape and connected to each other, at least one from the first and second portions being configured for rotating with respect to the other portion and with respect to the frame.

In a 31st aspect in accordance with the 30th aspect, both the first portion and the second portion of said at least one swivel arm bear a respective support element.

In a 32nd aspect in accordance with the 30th or 31st aspect, the mover device comprises a fourth auxiliary mover configured for moving translationally said at least one support element borne by the swivel arm in a substantially vertical direction.

In a 33rd aspect in accordance with any of the aspects from 17th through 32nd, said support elements and said one or more support cross-members are supported by the frame and arranged in the space in such a way as to form an operating area within which the possible movements of said support elements, of said one or more support cross-members, and/or of said operating element define a plurality of stability positions for a patient or for parts of the patient's body.

In a 34th aspect in accordance with the 33rd aspect, said stability positions can be selectively selected and/or interpolated by way of said control unit.

In a 35th aspect in accordance with any of the aspects from 1st through 34th, said control unit is configured for communicating by way of a wired connection or wirelessly with, and/or be managed and controlled wirelessly by:

an accessory, such as a remote control or a wearable accessory, and/or by a software and/or dedicated mobile application installed and/or configured for operating, preferably in at least partially automated manner, on a processor, computer, or mobile device, such as a smartphone, tablet, or laptop.

In a 36th aspect in accordance with any of the 1st through 35th aspects, said control unit is configured for being controlled by way of a voice command so that a patient, or an appointed person, is capable of controlling and managing the movements of the motor-driven operating portion by way of a voice command.

In a 37th aspect in accordance with any of the aspects from 1st through 35th, the mover device also comprises at least one housing and gripping element to house and grip parts and/or joints of said patient's body, said at least one housing and gripping element being engaged or engageable by a respective element, the housing and gripping element being configured for housing a part of a patient's body.

In a 38th aspect in accordance with the 37th aspect, said housing and gripping element is configured for being moved and/or translated in both directions, by getting closer to and/or moving away from the health and/or medical and/or domestic and/or orthopaedic installation and consequently for at least partially modifying the position in the space of a patient using said health and/or medical and/or domestic and/or orthopaedic installation.

In a 39th aspect in accordance with the 37th or 38th aspect, said housing and gripping element is configured for controlling the movements, and in particular for at least partially changing the position of and/or lifting a patient or parts of the patient's body, with respect to said health and/or medical and/or domestic and/or orthopaedic installation.

In a 40th aspect in accordance with the 37th, 38th, or 39th aspect, said housing and gripping element is configured for moving a patient or parts of a patient's body, from a health and/or medical and/or domestic and/or orthopaedic installation (for instance a bed) to a further health and/or medical and/or domestic and/or orthopaedic installation (for instance a wheelchair) arranged in proximity of said health and/or medical and/or domestic and/or orthopaedic installation.

In a 41st aspect in accordance with any of the aspects from 1st through 40th, the mover device is of a type installable on a floor and/or to a wall and/or to a health and/or medical and/or domestic and/or orthopaedic installation, such as a bed, a shower, and/or a bathtub.

In a 42nd aspect in accordance with any of the aspects from 1st through 41st, the mover device is a transportable and/or removable one, where by removable we mean that the mover device is configured for being removed from said floor or wall or health and/or medical and/or domestic and/or orthopaedic installation.

In a 43rd aspect there is provided a system comprising:

a mover device in accordance with any of the aspects from 1st through 42nd, an accessory, such as a remote control or a wearable accessory, a processor, a computer, a mobile device, such as a smartphone, a tablet, or a laptop, said accessory being configured for communicating in a wired mode or wirelessly with, and for controlling in a wired mode or wirelessly, said control unit in such a way as to allow for moving, and in particular at least lifting or changing the position of or re-positioning parts of a patient's body or of the patient himself/herself with respect to said health and/or medical and/or domestic and/or orthopaedic installation, or with respect to a further health and/or medical and/or domestic and/or orthopaedic installation (for instance a wheelchair) arranged in proximity of said health and/or medical and/or domestic and/or orthopaedic installation.

In a 44th aspect in accordance with the 43rd aspect, said accessory is a processor, a computer, or a mobile device, such as a smartphone, tablet, or laptop, and the system also comprises a software and/or a mobile application installed and/or configured for operating on said processor, computer, or mobile device, the software and/or mobile application being configured for allowing for a wirelessly communication with, and for wirelessly controlling said control unit, so as to allow for moving, and in particular at least lifting a patient with respect to said health and/or medical and/or domestic and/or orthopaedic installation.

In a 45th aspect in accordance with the 44th aspect, the software and/or mobile application are configurable and/or customizable, for instance by a physiotherapist, a doctor, or an appointed person skilled for this purpose, according to the specific requirements of any specific patients.

In a 46th aspect in accordance with the 44th or 45th aspect, the software and/or mobile application are configured for allowing creation, modification, and storage of appropriate physioterapic movement programs and/or supporting programs in a memory.

In a 47th aspect in accordance with any of the aspects from 43rd through 46th, said accessory is a wearable accessory, for instance a cuff or a sleeve, the accessory being wearable for instance by a patient, a doctor, an assistant, or an authorized person.

In a 48th aspect in accordance with any of the aspects from 43rd through 47th, said accessory is of the movement recognition type, and the check and control unit is configured for translating specific movements of the wearable accessory into specific movements of said support elements and/or into specific patient's moving programs.

In a 49th aspect in accordance with any of the aspects from 1st through 48th, said health and/or medical and/or domestic and/or orthopaedic installation is of a movable type (for instance, a wheelchair) or of a fixed type (for instance, a bed or a bathtub) and can include any health installation (for instance, a bathtub or a shower) and/or a medical installation (for instance, a hospital bed) and/or a domestic installation (for instance, an armchair, a sofa, or a chair) and/or an orthopaedic installation (for instance, a wheelchair or a transportation device, for transferring elderly and/or disabled persons).

In a 50th aspect, the mover device in accordance with any of the aspects from 1st through 42nd and the system in accordance with any of the aspects from 43rd through 48th are particularly intended for a domestic use by a private (for instance, at a patient's home) or for use in a public facility (such as a hospital or rehabilitation centre) or in a private facility (such as a clinic).

In a 51st aspect, in the mover device in accordance with any of the aspects from 1st through 42nd, and/or in the system in accordance with any of the aspects from 43rd through 48th, every support element is movable according to at least two degrees of freedom.

In a 52nd aspect, in the mover device in accordance with any of the aspects from 1st through 42nd, and/or in the system in accordance with any of the aspects from 43rd through 48th, every support element is movable according to at least three degrees of freedom.

In a 53rd aspect, which can be taken independently or dependently on any of the aspects from 1st through 52nd, there is provided a mover device for the body of patients and/or persons with reduced mobility, suitable and configured for being operationally positioned above or close to a health and/or medical and/or domestic and/or orthopaedic installation, be it movable or fixed, for instance a support, a bed, a seat, a shower, and/or a bathtub, the mover device comprising:

- a frame comprising a binding portion configured for positioning said mover device in a stable equilibrium above or close to said health and/or medical and/or domestic and/or orthopaedic installation,
- a motor-driven operating portion, supported by said frame on an upper surface or portion of the frame and at least partially overhanging, or arranged close to said health and/or medical and/or domestic and/or orthopaedic installation, said motor-driven operating portion comprising a plurality of support elements, for instance cables, belts, or elongate traction elements, every support element being movable according to at least one degree of freedom and/or along at least one axis in the space and being configured for:
  - at least partially or fully supporting the weight of a patient,
  - being moved, in particular translationally and/or rotationally moved,
  - moving at least one respective part of a patient's body according to said at least one degree of freedom and/or along said at least one axis with respect to said health and/or medical and/or domestic and/or orthopaedic installation, and/or
  - moving parts of said patient's body in order to at least partially modify the position in the space of a patient in the space and/or to make parts of a patient's body get closer to the health and/or medical and/or domestic and/or orthopaedic installation and/or to make them move away from the health and/or medical and/or domestic and/or orthopaedic installation,
- at least one housing and gripping element to house and grip parts and/or joints of said patient's body, said at least one housing and gripping element being engaged or engageable with a respective support element, the housing and gripping element being configured for operating at least between:
  - a rest condition wherein it is engageable with a part and/or joint of said patient's body,
  - a grip condition wherein said at least one housing and gripping element is engaged with a part and/or joint of said patient's body.

In a 54th aspect in accordance with the 53rd aspect, in the grip condition said at least one housing and gripping element is in a stimulated or energized condition wherein said inner chamber features a shape, pressure, or volume different from a shape, pressure, or volume, said inner chamber is in the rest condition.

In a 55th aspect in accordance with the 53rd or 54th aspect, the mover device also comprises a control unit configured for controlling and/or programming the movements of said support elements so as to allow for moving, and in particular at least lifting and/or at least partially changing the position of or re-positioning said parts of the patient's body or of a patient himself/herself with respect to said health and/or medical and/or domestic and/or orthopaedic installation, or with respect to a further health and/or medical and/or domestic and/or orthopaedic installation arranged in proximity of said health and/or medical and/or domestic and/or orthopaedic installation.

In a 56th aspect in accordance with the 53rd, 54th or 55th aspects, said at least one housing and gripping element is configured and/or shaped for engaging a respective support element in order for making it possible for it to be moved by said support element, in an engagement condition with said support element, said at least one housing and gripping element being also configured for:

a. being moved and/or translating in two directions, by getting closer to and/or moving away from the health and/or medical and/or domestic and/or orthopaedic installation and consequently at least partially modifying the position in the space of a patient using said health and/or medical and/or domestic and/or orthopaedic installation, b. moving, and in particular at least partially changing the position of and/or lifting a patient with respect to said health and/or medical and/or domestic and/or orthopaedic installation, and/or c. moving a patient, or parts of a patient's body, from a health and/or medical and/or domestic and/or orthopaedic installation to a further health and/or medical and/or domestic and/or orthopaedic installation arranged in proximity of said health and/or medical and/or domestic and/or orthopaedic installation.

In a 57th aspect in accordance with any of the aspects from 53rd through 56th, said at least one housing and gripping element includes an inner chamber configured for getting deformed and/or changing its own shape, for instance by increasing or decreasing a volume of its own and/or an internal pressure of its own, as a consequence of an external energization or stimulation.

In a 58th aspect in accordance with any of the aspects from 53rd through 57th, said at least one housing and gripping element includes an inner chamber containing, or is configured for containing, a fluid or a composition suitable for varying its own pressure and/or getting deformed and/or changing its own shape and/or volume as a result of an external energization or stimulation.

In a 59th aspect in accordance with the 57th or 58th aspect:

said at least one housing and gripping element includes an outer shell, by inner chamber we mean a chamber housed, arranged, or derived inside said shell.

In a 60th aspect in accordance with any of the aspects from 53rd through 59th, said at least one housing and gripping element includes a quick fastener, the mover device also comprising an operating device configured for being connected to said quick fastener to provide said external energization or stimulation to said at least one housing and gripping element.

In a 61st aspect in accordance with the 60th aspect, said operating device is integral with and/or can be part of said at least one housing and gripping element.

In a 62nd aspect in accordance with any of the aspects from 57th through 61st, said inner chamber is an elastic and/or deformable chamber configured for featuring a greater volume in a grip condition of said at least one housing and gripping element with respect to a volume that said chamber has in a rest condition of said at least one housing and gripping element.

In a 63rd aspect in accordance with any of the aspects from 58th through 62nd, said chamber is of a pneumatic type and contains, or is configured for containing, air or other gases.

In a 64th aspect in accordance with any of the aspects from 58th through 62nd, said chamber is of a hydraulic type and contains, or is configured for containing, an incompressible fluid.

In a 65th aspect in accordance with the aspect from 63rd or 64th, the chamber features an internal pressure greater in a grip condition than the internal pressure said chamber has in a rest condition.

In a 66th aspect in accordance with any of the aspects from 53rd through 61st, said inner chamber is deformable, the operating device being configured for decreasing the pressure internally to the chamber down to a pressure lower than the ambient pressure, in particular in order to create a substantially vacuum condition internally to the chamber, so that the chamber features a lower volume in a grip condition of said at least one housing and gripping element with respect to the volume said chamber has in the a condition of said at least one housing and gripping element.

In a 67th aspect in accordance with the 66th aspect, said inner chamber includes a plurality of deformable elements arranged internally thereto, said deformable elements being configured for getting deformed in order to grip said parts and/or joints of said patient's body in a grip condition of said at least one housing and gripping element.

In a 68th aspect in accordance with any of the aspects from 53rd through 61st, said chamber includes electro-active materials (for instance polymers) or "smart" materials configured, for instance, for:

being electrically energized, and/or being chemically energized, and/or being thermally energized, and/or changing their own shape in the electrically energized condition, and/or shrinking in order to temporarily create pressures on at least a part of a patient's body via at least one housing and gripping element wound around said part of the patient's body.

In a 69th aspect in accordance with the 68th aspect, the electrical energization of the electro-active materials causes a transition of said at least one housing and gripping element from a rest condition to a grip condition, the change of shape of the electro-active materials making it possible for said at least one housing and gripping element to grip parts and/or joints of said patient's body.

In a 70th aspect, which can be taken independently on or dependently on any of the aspects from 53rd through 69th, there is provided a garment, for instance a pyjama, a pair of trousers, a nightshirt/nightdress, or a T-shirt, configured for being worn by a patient and/or by a person with reduced mobility, said garment comprising at least one housing and gripping element to house and grip parts and/or joints of the body of said patient and/or said person with reduced mobility in correspondence with at least a portion of the garment intended for being put, in conditions of use of said garment wherein the garment is worn by said patient and/or by said person with reduced mobility, in correspondence with or in proximity of parts and/or joints of said patient's body, said at least one housing and gripping element being engageable or engaged with a respective support element of a mover device in accordance with any of the 1st through 69th aspects, the housing and gripping element being configured for operating at least between:

a rest condition wherein it is engageable with a part and/or joint of said patient's body, a grip condition wherein at least one housing and gripping element engages a part and/or joint of said patient's body.

In a 71st aspect in accordance with the 70th aspect and with any of the aspects from 53rd through 69th, the mover device comprises said garment.

In a 72nd aspect in accordance with the 70th or 71st aspect, said garment is a pyjama, a pair of trouser, a nightshirt/nightdress, or a T-shirt.

In a 73rd aspect in accordance with any of the 1st through 72nd aspects, the mover device comprises a patient position recognition device configured for recognizing the real-time position of the patient, said patient position recognition device being connected to said control unit.

In a 74th aspect in accordance with the 73rd aspect, said patient position recognition device are configured for recognizing the real-time position of a patient even below or across elements and/or obstacles interposed between a patient and said patient position recognition device, said elements and/or obstacles being for instance blankets, pillows, or garments.

In a 75th aspect in accordance with the 73rd or 74th aspect, said control unit is configured for:

receiving information about a patient's position from said patient position recognition device, processing said information coming from said patient position recognition device, operating at least one support element and/or at least one housing and gripping element so as to move said patient or to pre-set the patient and/or the mover device to moving the patient as a function of said information coming from said patient position recognition device.

In a 76th aspect in accordance with the 73rd, 74th, or 75th aspect, said patient position recognition device comprises at least a thermal imaging chamber.

In a 77th aspect in accordance with any of the aspects 1st through 76th, the mover device comprises a device configured for making the connection and disconnection between a patient and the mover device easier and/or for making the connection between the mover device and the patient take place autonomously and/or automatically without a help by a further person or health operator.

In a 78th aspect in accordance with the 77th aspect and with any of the aspects from 73rd through 76th, said device configured for making the connection and disconnection between a patient and the mover device easier comprise or correspond to or constitute said patient position recognition device.

In a 79th aspect there is provided a procedure for moving patients and/or persons with reduced mobility, comprising the following steps:

pre-setting a mover device in accordance with any of the aspects from 1st through 78th, making said at least one housing and gripping element engage a part and/or joint of said patient's body so as to effect a transition of said at least one housing and gripping element from a rest condition to a grip condition, connecting at least one of said support elements to said at least one housing and gripping element so as to firmly engage and keep said at least one housing and gripping element integral with said support element, by way of said control unit, operating said at least one support element so as to allow to move, and in particular to at least lift and/or at least partially change the position of or re-position the part and/or joint of the patient's body engaged with said at least one housing and gripping element with respect to said health and/or medical and/or domestic and/or orthopaedic installation, or with respect to a further health and/or medical and/or domestic and/or orthopaedic installation arranged in proximity of said health and/or medical and/or domestic and/or orthopaedic installation.

In an 80th aspect in accordance with the 79th aspect, the procedure also comprises a step of stimulating or energizing said inner chamber so as to increase or decrease a volume and/or an internal pressure of said chamber and/or to make said inner chamber get deformed and/or change its own shape.

In an 81st aspect in accordance with the 80th aspect, the step of connecting at least one of said support elements to said at least one housing and gripping element follows the step of stimulating or energizing said inner chamber.

In an 82nd aspect in accordance with the 81st aspect, the step of connecting the support element to the housing and gripping element is performed, the operating device being connected to the quick fastener of the housing and gripping element.

In an 83rd aspect in accordance with the 81st aspect, the step of connecting the support element to the housing and gripping element is performed after disconnecting the operating device from the quick fastener of the housing and gripping element.

In an 84th aspect in accordance with the 80th aspect, the step of connecting at least one of said support elements to said at least one housing and gripping element precedes the step of stimulating or energizing said inner chamber.

In an 85th aspect in accordance with any of the 79th through 84th aspects, the procedure also comprises a step of energizing said at least one housing and gripping element so as to increase or decrease an outer circumference thereof in order to exert a given pressure on said part and/or joint of said patient's body.

In an 86th aspect in accordance with any of the aspects from 1st through 78th, the mover device comprises a slide configured for rotationally moving along an axis.

In an 87th aspect in accordance with the 86th aspect, the slide engages the operating element and is configured for rotating integrally with said operating element.

In an 88th aspect in accordance with the 86th or 87th aspect, the mover device comprises rails engaging the operating element, said rails being parallel and respectively opposed with reference to their arrangement on the operating element.

In an 89th aspect in accordance with the 88th aspect, the slide is configured for rotationally translating along said rails.

In a 90th aspect in accordance with any of the aspects from 86th through 89th, the slide comprises auxiliary rails.

In a 91st aspect in accordance with any of the aspects from 86th through 90th, the mover device also comprises at least one support cross-member engaging said slide in correspondence with opposite end portions.

In a 92nd aspect in accordance with the 91st aspect, said support cross-member is configured for rotationally translating in an independent manner along an axis that is orthogonal, and in particular coplanar with the axis of translation of said slide.

In a 93rd aspect in accordance with the 92nd or 91st aspect when also dependent on the 90th aspect, said support cross-member is configured for rotationally translating along said auxiliary rails of the slide.

In a 94th aspect in accordance with the 93rd or 92nd aspect, the translation of the slide along said axis implies an integral translational movement of the support cross-members along said axis of rotation of the slide.

In a 95th aspect in accordance with any of the aspects from 91st through 94th, the mover device comprises at least one swing arm, said swing arm engaging said support cross-member and being configured for rotating with respect to said support cross-member.

In a 96th aspect in accordance with the 95th aspect, said swing arm bears a respective support element.

In a 97th aspect in accordance with the 96th aspect, the mover device comprises a fourth mover configured for moving said support element at least along a vertical translational movement.

In a 98th aspect in accordance with the 97th aspect, the fourth mover is configured for moving said support element in both directions, by getting closer to and moving away from the installation.

In a 99th aspect in accordance with the 97th or 98th aspect, said fourth mover is borne by a respective arm.

In a 100th aspect, said fourth mover is borne by a respective arm in correspondence with an end of said arm.

BRIEF DESCRIPTION OF THE FIGURES

FIG. 7 shows an accessory configured for communicating with a control unit of the mover device in accordance with the invention;

FIG. 8 shows a housing and gripping element engaging a patient's knee and supported by a support element of the mover device in accordance with the invention;

FIG. 9 shows a mover device in accordance with an embodiment of the concepts herein arranged above a bed;

DETAILED DESCRIPTION

Figure 1:
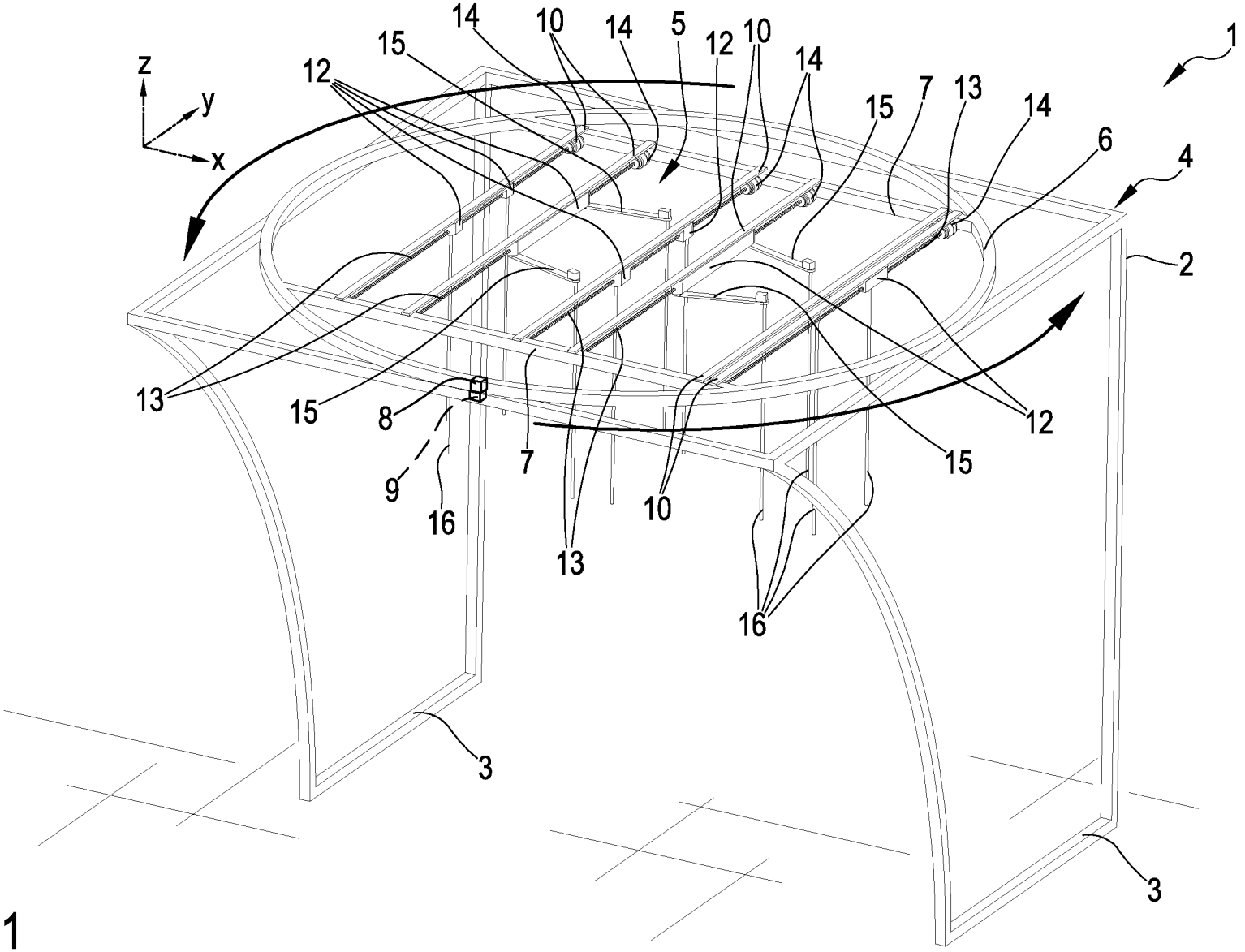
FIG. 1 shows a front view of a mover device in accordance with an embodiment of the present invention.

In the figures, the reference numeral 1 identifies a mover device in accordance with the present concepts herein as a whole. In the context of the present description, by mover device 1 we mean a device conceived, pre-set, and configured for moving, either partially or completely, the body of a patient or person having reduced motor skills. In the context of the present description, the term "patient" can be construed in general as "user", i.e. in the meaning of a person who potentially can take advantage of the use of a mover device in accordance with the invention. For explanatory not limitative purposes only, examples of users or patients are given below for whom a mover device in accordance with the concepts herein can be used in a particularly advantageous manner. A user or patient who needs a support and aid in moving his/her own parts of the body, or his/her own body in its entirety, might have temporarily limited motor skills, for instance because of a crash or an accident (i.e. a person who suffers a road accident or an athlete recovering from a sport injury), or it might be a matter of a user or patient, more or less elderly, having permanent limited motor skill. Also, a mover device 1 in accordance with the concepts herein can be used both in the medical-hospital environment, for assisting elderly or disabled patients and/or persons having reduced mobility in general, both in a private environment, for instance in the house of a person having reduced mobility, just in order to assist and increase his/her own motor skills. The following is a complete description of a preferred embodiment of the invention, with a number of particularly advantageous variants thereof. The mover device 1 is conceived and configured for being positioned above (or in proximity of) with respect to a health and/or medical and/or domestic and/or orthopaedic installation 100, 100', which will be identified, for ease of reference, as "installation" or "said installation" in the rest of this description. The installation 100, 100' can be of a movable or fixed type, and in particular can be at least one of the following installations 100, 100': a support, a bed, a couch (for instance a couch used for physiotherapy, rehabilitation, and/or orthopaedic sessions), a seat (such as a chair, an armchair, a sofa, and the like), a shower, a bathtub and similar installations wherein a patient has reduced mobility, because of his/her own limited mobility and/or because of the nature of the installation 100, 100' itself which sometimes does not allow for an easy and comfortable positioning of the patient (for instance, a bathtub). Ultimately, the installation 100, 100' can be any health installation (for instance, a bathtub or a shower) and/or a medical installation (for instance, a hospital bed) and/or a domestic installation (for instance, an armchair, a sofa, or a chair) and/or an orthopaedic installation (for instance, a wheelchair or a transportation device, for transferring elderly and/or disabled persons). The mover device 1 comprises a frame 2 suitable for firmly supporting the mover device 1 itself. The frame 2 is pre-set and configured for being secured to the ground or floor, in order to provide a firm constraint. In a variant, the frame 2 can be secured to the installation 100, 100' itself above which it is arranged. In a further variant, the frame 2 can be secured to a wall or a ceiling, on a side or above and in proximity of the installation 100, 100' above which it is configured for assisting a user in his/her movements. The frame 2 comprises a binding portion 3 just configured for positioning the mover device 1 in a stable equilibrium in proximity of, or at least partially above, the installation 100, 100'. The frame 2 can be partially or completely made of metal material, in order to provide a firm support to the mover device 1. The frame 2 comprises an upper portion 4 which, in an operating configuration of the mover device 1, can be at least partially arranged above the installation 100, 100'. The mover device 1 also comprises a motor-driven operating portion 5, supported by the frame 2 on an upper surface or portion of the frame itself. By motor-driven operating portion 5, we mean a portion of the mover device 1 comprising a plurality of movers (for instance electric motor, preferably DC, stepping, or synchronous motors), whose operation and main technical characteristics will be described below. As shown in the attached figures, the mover device 1 also comprises an operating element 6 supported by the frame 2 in correspondence with the upper portion of the frame and being part of the motor-driven operating portion 5. The operating element 6 engages rotationally the upper portion of the frame 2 and is supported, in the embodiment here shown, by an upper surface of the frame 2 itself. The operating element 6 preferably has one degree of freedom, consisting of its rotation with respect to the frame 2. The rotation of the operating element preferably takes place about an axis that is substantially vertical and orthogonal with respect to the upper surface or portion of the frame 2. The operating element 6 is thus configured for rotating with respect to the frame 2 in the same plane as the upper surface of the frame 2 or in a plane parallel to a plane defined by the upper surface of the frame 2. In a variant, the operating element 6 can rotate in a plane transversal with respect to the plane defined by the upper surface of the frame 2. In order to make its rotation easier, the operating element 6 features an at least partially curvilinear outline or profile, and in particular a completely curvilinear outline or profile. Preferably is the operating element 6 shaped like a circumference (the embodiment illustrated in the attached figures) or, alternatively like an ellipse or like a rectangular structure or auxiliary frame, also rotatable with respect to the frame 2

Figure 2:
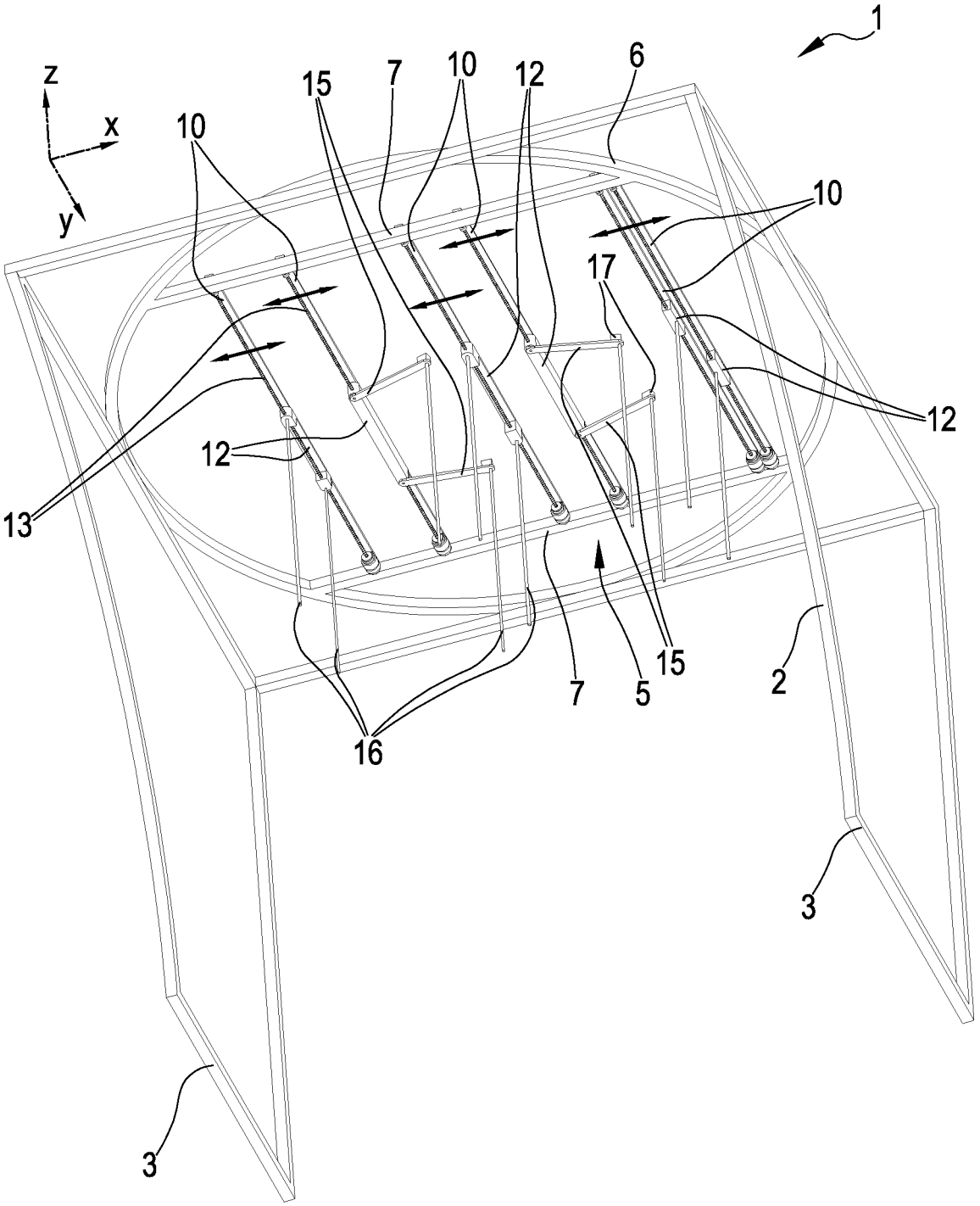
FIG. 2 shows a bottom view of the mover device of FIG. 1.

(these variants are not shown in the attached figures). The operating element 6 also comprises at least one guide rail 7, or a pair of guide rails 7, whose technical function will be better explained below. The embodiment here illustrated shows an operating element 6 provided with a pair of guide rails 7, and consequently reference will be made to a pair of guide rails 7 below in order to make the explanation simpler, with no prejudice for other technical solutions. To make it possible for the operating element 6 to rotate, the motor-driven operating portion 5 comprises a first mover 8. The first mover 8 is just configured for driving the operating element 6 into rotation. The first mover 8 can be an electric motor, for instance a DC or stepping motor. In accordance with one embodiment, the first mover 8 is housed on board the operating element 6 itself and rotates integrally therewith. In order to make the rotation of the operating element 6 easier, the frame 2 comprises a guide 9 conceived and configured for allowing for the operating element 6 to rotate with respect to the frame 2 itself. For instance, the coupling between the operating element 6 and the frame 2 can be of a type that uses gearwheels, wherein the guide 9 is substantially a rack and the first mover 8, integral with the operating element 6 itself, drives a first gearwheel into rotation, which allows for the rotation of the operating element 6, just movable with respect to the frame 2, with respect to the guide 9, which is firmly secured to the frame 2. In a further embodiment of said mover 8, not shown in the attached figures, it is possible to think about a motor provided with a rubber pinion in contact with the first mover 8 to make it rotate with respect to the frame 2. The motor-driven operating portion 5 of the mover device also comprises a plurality of support cross-members 10 supported by the operating element 6. The support cross-members 10 feature respective main directions of development and are arranged parallel to each other (see for instance FIGS. 1 and 2). The support cross-members 10 are supported by and engage the operating element 6 by way of the pair of guide rails 7 and are configured for moving translationally along the guide rails 7. In particular, each support cross-member 10 is able to move translationally along the guide rails 7 independently of the remaining support cross-members 10. Below the support cross-member 10 there is provided a transversal moving system which transversally moves the support cross-members 10, driven by an auxiliary mover 14 and also arranged below with respect to the support cross-member 10 itself, and an element 13 suitable for being driven into rotation by the auxiliary mover 14. The element 13 preferably has a shape elongating along a main direction of development, which also operates as an axis of rotation for the element 13 itself. As the attached figures show, the element 13 can be for instance formed of a endless screw directly operated by the auxiliary mover 14, or alternatively an alternator belt system (not shown in the attached figures) can be used. Operationally wise, the rotation of element 13 and/or the belt system causes the translational movement of the intermediate connection elements 12 transversally to the support cross-members 10. By a specifically designed drive, contained in the auxiliary mover 14 and on board said support cross-members 10, it is also possible to move the support cross-members 10 along the rails 7. Alternatively, the drives contained in the auxiliary mover 14 and configured for allowing for the movement of the support cross-members 10 can also be grouped together outside the support cross-members 10, for instance on a specifically developed support, not shown here, and can be connected thereto by way of belt systems and/or a transmission.

The mover device 1 also includes intermediate connection elements 12, slidable parallel to the main direction of development of the support cross-members 10. The intermediate connection elements 12 are mounted on respective rotation bars 13 and can slide along them and can consequently be considered as being part of the motor-driven operating portion 5. The mover device 1 possibly includes at least one intermediate connection element 12 for every support cross-member 10 and consequently for every rotation bar 13; for instance, the embodiment illustrated in the attached figures includes only one intermediate connection element 12 for every support cross-member. However, variants can be envisaged wherein there are several intermediate connection elements 12 for every support cross-member 10. In order to make it possible for the intermediate connection elements 12 to slide along their respective rotation bar 13, the motor-driven operating portion 5 includes a third mover 11*a*, which might be an electric motor, for instance a DC or stepping motor.

Figure 12:
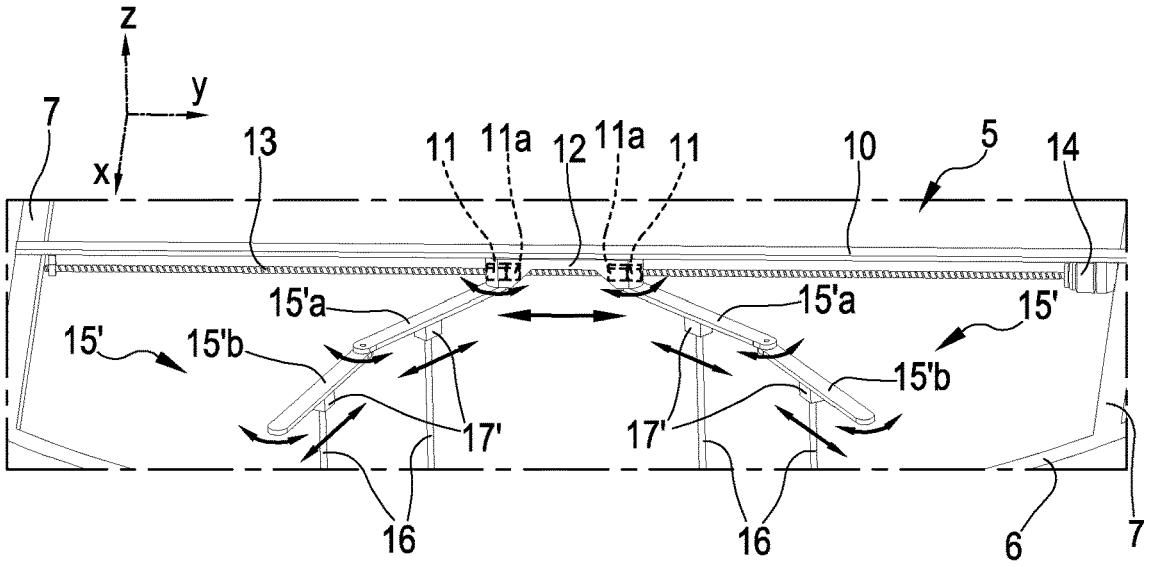
FIG. 12 shows a detail of the motor-driven operating portion of the mover device of FIG. 13.
Figure 13:
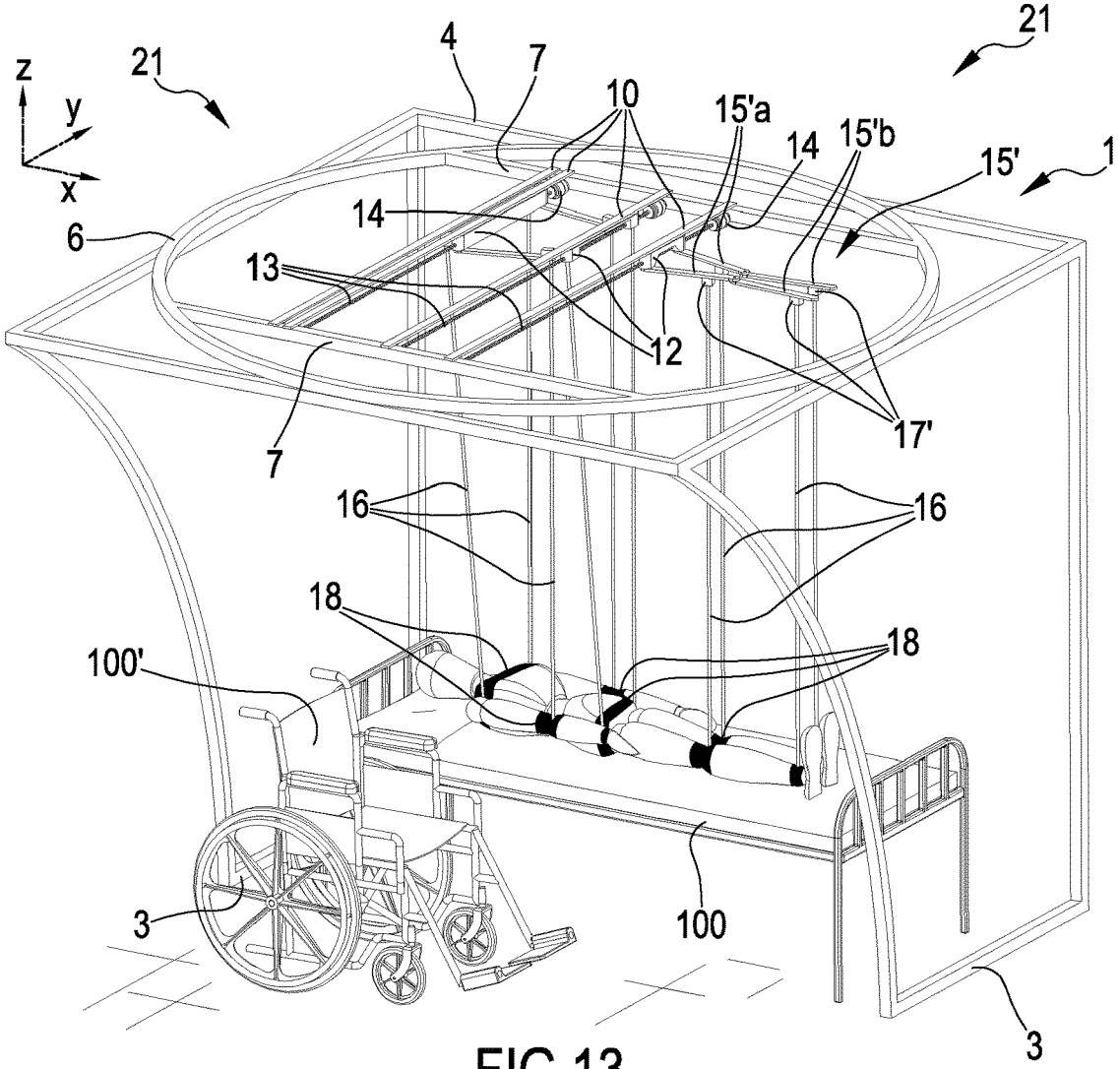
FIG. 13 shows a mover device in accordance with a further embodiment of the concepts herein arranged above a bed.

The mover device 1 might also include at least one swing arm 15, 15' mounted on a support cross-member 10, either directly or indirectly by way of at least one intermediate connection element 12. Advantageously are at least two swing arms 15, 15' provided for one and the same support cross-member 10, as shown in detail in FIG. 4. The swing arms 15, 15' are hinged to one intermediate connection element 12 and are configured for rotating with respect to the support cross-member 10 and to the operating element 6 below which they are arranged, as also with respect to the frame 2. In order to drive the swing arms 15, 15' into rotation, the motor-driven operating portion 5 possibly includes one second mover 11 for every swing arm 15, 15', or one second mover 11 for both swing arms 15, 15'. Owing to their own rotatory degree of freedom, the swing arms 15, 15' have been conceived, and are particularly suitable for being used to move joints of a patient's body, such as his/her knees and/or ankles and/or elbows and/or wrist. For this purpose, i.e. in order to provide for a correct and efficient movement of said parts of a patient's body, the swing arms 15, 15' can be either of a simple type (swing arms 15, see FIG. 4) or of a swivel type (arms 15', see figure N). The swivel arms 15' include a first portion 15'*a* and a second portion 15'*b* featuring a preferred direction of development and connected to each other, for instance in correspondence with their respective ends. The first portion 15'*a* is connected to a respective intermediate connection element 12 in correspondence with an end of its own and is connected to the second portion 15'*b* in correspondence with an opposed end. Preferably are the first and second portions 15'*a*, 15*b* hinged to each other and motor-driven. In particular, the second portion 15'*b* is swivelled on the first portion 15'*a* in such a way as to be rotatable with respect thereto and to be able to move translationally along the main development direction of the first portion 15'*a*. As shown in figure N, in the embodiment that uses swivel arms, a lower number of support cross-members can be used with respect to the embodiment that uses simple swing arms 15. As a matter of fact, in the embodiment that uses simple swing arms 15, as many as three different support cross-members 10 are used in order for knees and ankles to correctly move which, by way of their respective intermediate connection elements 12 and support elements 16, move the patient's knees (moved by a support cross-member 10 bearing, by way of the intermediate connection element 12, simple swing arms 15) and ankles (each ankle is moved by way of a dedicated support cross-member 10) respectively. Conversely, the embodiment that uses swivel arms 15' is such that knees and ankles are moved by way of one support cross-member 10, which just carries the swivel arms 15' (see FIGS. 12 and 13, which show a pair of swivel swing arms 15'). Each first portion 15'*a* and each second portion 15'*b* of the pair of swivel arms 15' bear a respective support element 16 which can slide back and forth along its respective portion 15'*a*, 15'*b* of the swivelled swing arms 15'. Each support element 16 is moved by a respective fourth auxiliary mover 17' and is intended for moving the patient's knees or ankles (see FIG. 13). In more details, as shown in FIG. 13, each support element 16 borne by the first portion 15'*a* of each auxiliary swing arm 15' is configured for moving a respective patient's knee, whereas each support element 16 borne by the second portion 15'*b* of each auxiliary swing arm 15' is configured for moving a respective patient's ankle. The rotation of the second portion 15'*b* with respect to the first portion 15'*a* is controlled by a second auxiliary mover, not shown in the attached figures. The second auxiliary mover, which can substantially be of a type similar or identical to the second mover 11, can be arranged for instance at a terminal end of the first portion 15'*a* or on a terminal end of the second portion 15'*b*, and however preferably in proximity of the connection between the first and second portions 15'*a*, 15'*b*.

Figure 3:
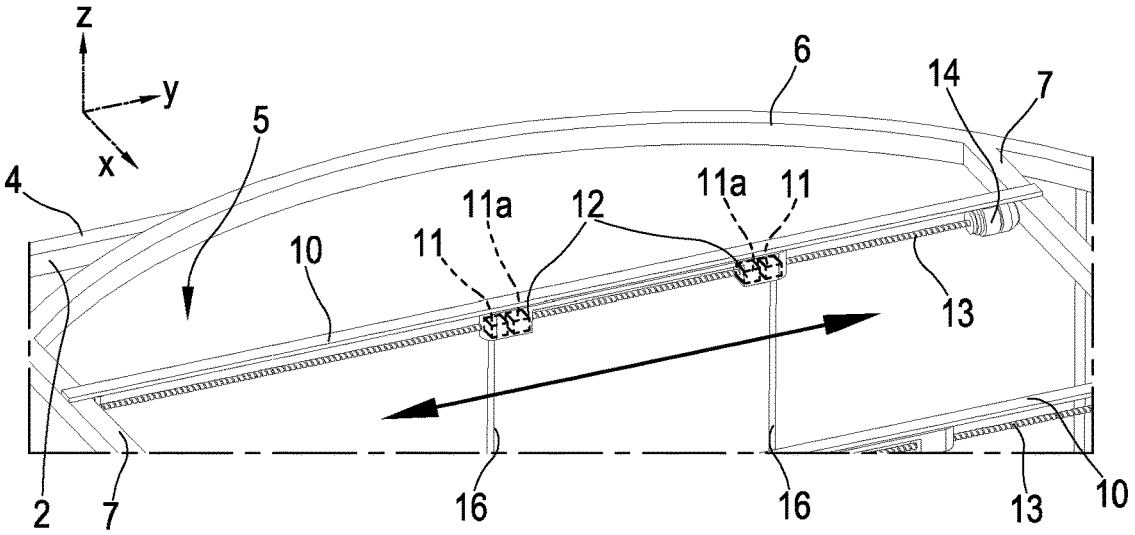
FIGS. 3-5 show respective details of the motor-driven operating portion of the mover device of FIG. 1.
Figure 4:
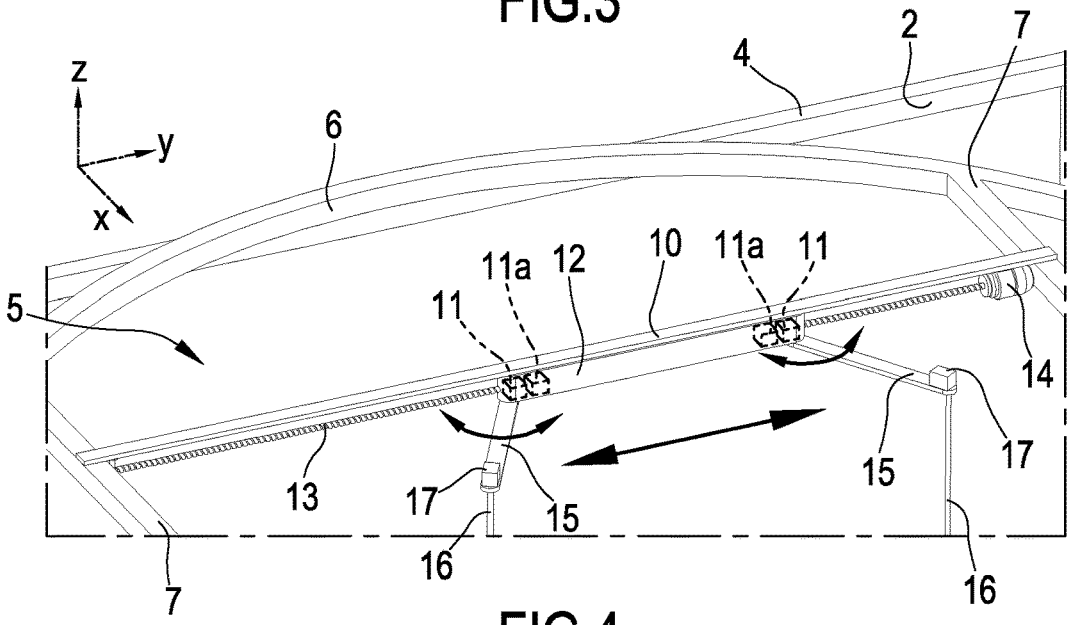
Figure 5:
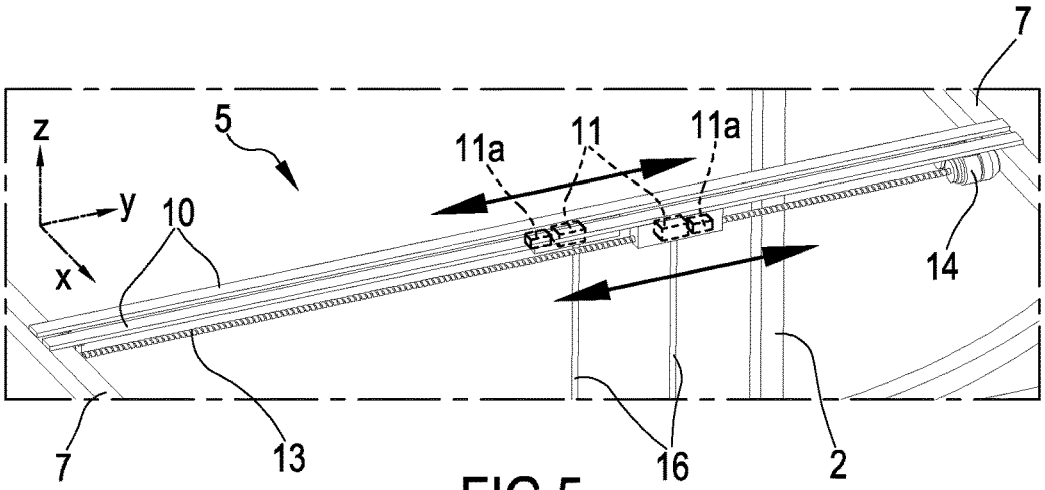
Figure 6:
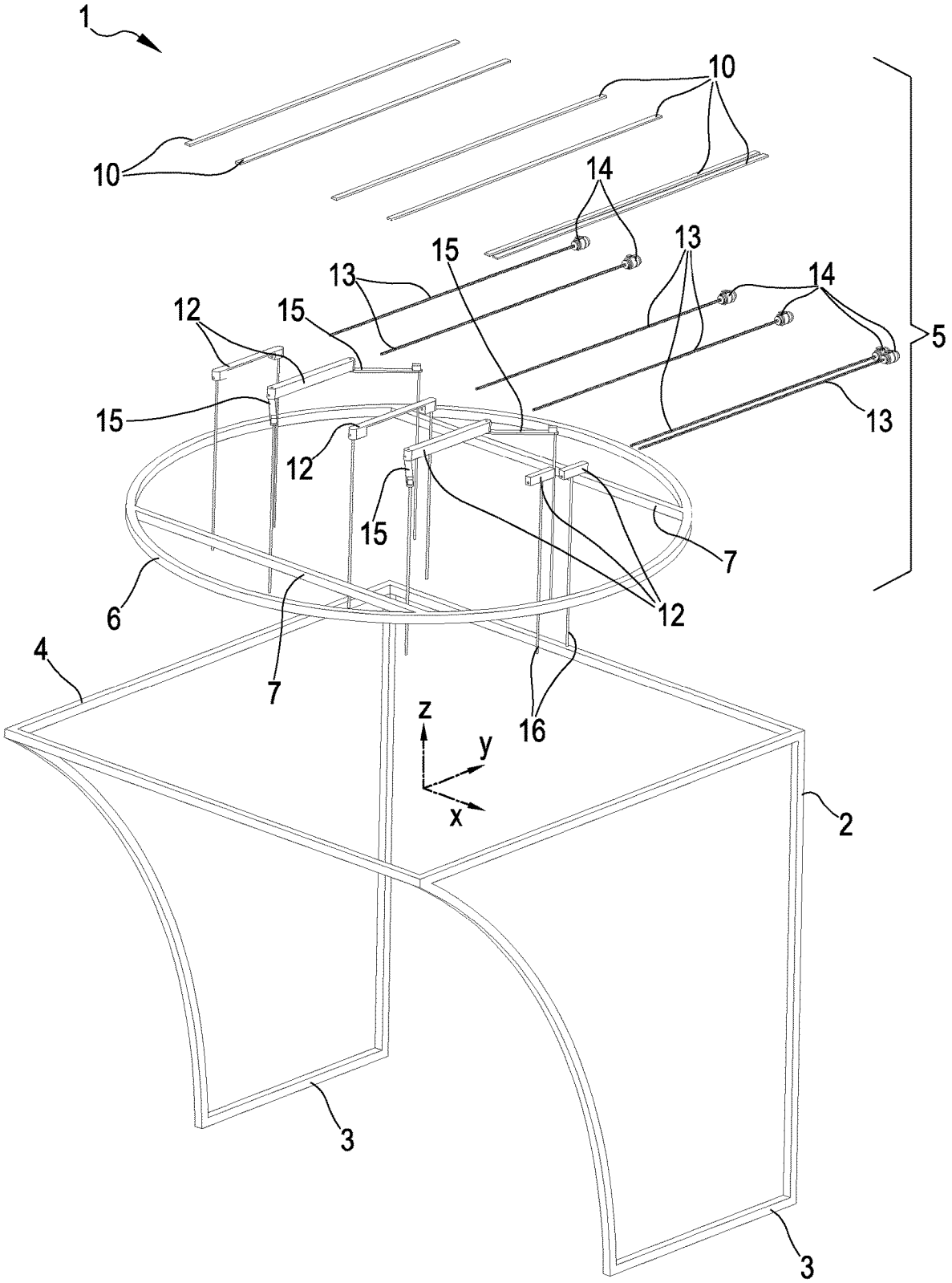
FIG. 6 shows an exploded view of a mover device in accordance with an embodiment of the present invention.

The operating portion 6 also comprises a plurality of support elements 16 that are at least translationally movable, to get closer to or move away from the installation 100, 100', hence to/from the patient located above the installation 100, 100', or in proximity of the installation 100, 100' itself. The support elements 16 engage the operating element 6 indirectly, i.e. by way of intermediate connection elements 12 and support cross-members 10, and consequently are configured for rotating integrally with the operating element 6. Operationally wise, the support elements 16 can feature at least one degree of freedom and can move, or be moved, along at least one axis in the space; said axis is preferably the z axis, the axis along which the vertical translation of the support elements 16 takes place. The support elements 16 are configured and structured for being traction-operated and can include for instance belts, wires, ropes, or elongate traction elements in general. Each support element 16 is configured for at least partially or entirely supporting a patient's weight and is pre-set for engaging and moving at least one respective part of the patient's body in the space and with respect to the installation 100, 100', in accordance with the degrees of freedom it benefits from. The movement of parts of the patient's body transmitted by the support elements 16 aims at least partially modifying the position of the parts of a patient's body in the space, for instance by way of a translation, rotation, or roto-translation of said at least one respective part of the patient's body, by preferably getting closer to and/or moving away from the installation 100, 100'. The movement of each support element 16 is possible because the motor-driven operating portion 5 includes a plurality of fourth movers 17, each of which is configured for moving a respective support element 16 at least in a vertical translation movement, and in particular by getting closer to the installation 100, 100' and moving away from the installation 100, 100'. Each fourth mover 17 possibly includes an electric motor, for instance a DC or stepping motor, and a pulley which is engaged by a respective support element 16. Operationally wise, the electric motor drives into rotation the pulley, which the support element 16 is wound on or unwound from in order to make a part of the patient's body get closer to or move away from the installation 100, 100' in the operating conditions of the mover device 1. As shown in FIGS. 3, 4, and 5, each fourth mover 17 can be mounted on board an intermediate connection element 12 (or alternatively on board the support cross-member 10 above the support element 16) and consequently it is integral with the intermediate connection element 12 itself in its translational movement. In the embodiment here shown, the support elements 16 engage the intermediate connection elements 12, which just operate as a connection between support elements 16 and support cross-members 10, or the swing arms 15. Three solutions are described below which can be adopted to efficiently arrange the support elements 16 below the support cross-members 10. FIG. 3 shows a support cross-member 10 below which there is arranged an intermediate connection element 12 which is engaged by two support elements 16, in correspondence with its own opposed ends. Conversely, FIG. 4 shows an intermediate connection element 12 which two swing arms 15 are hinged to in correspondence with its opposed ends, each of which bears a respective support element 16. Conversely, FIG. 5 shows two parallel support cross-members 10, below each of which one intermediate connection element 12 only, bearing a respective support element 16, is engaged.

Figure 25:
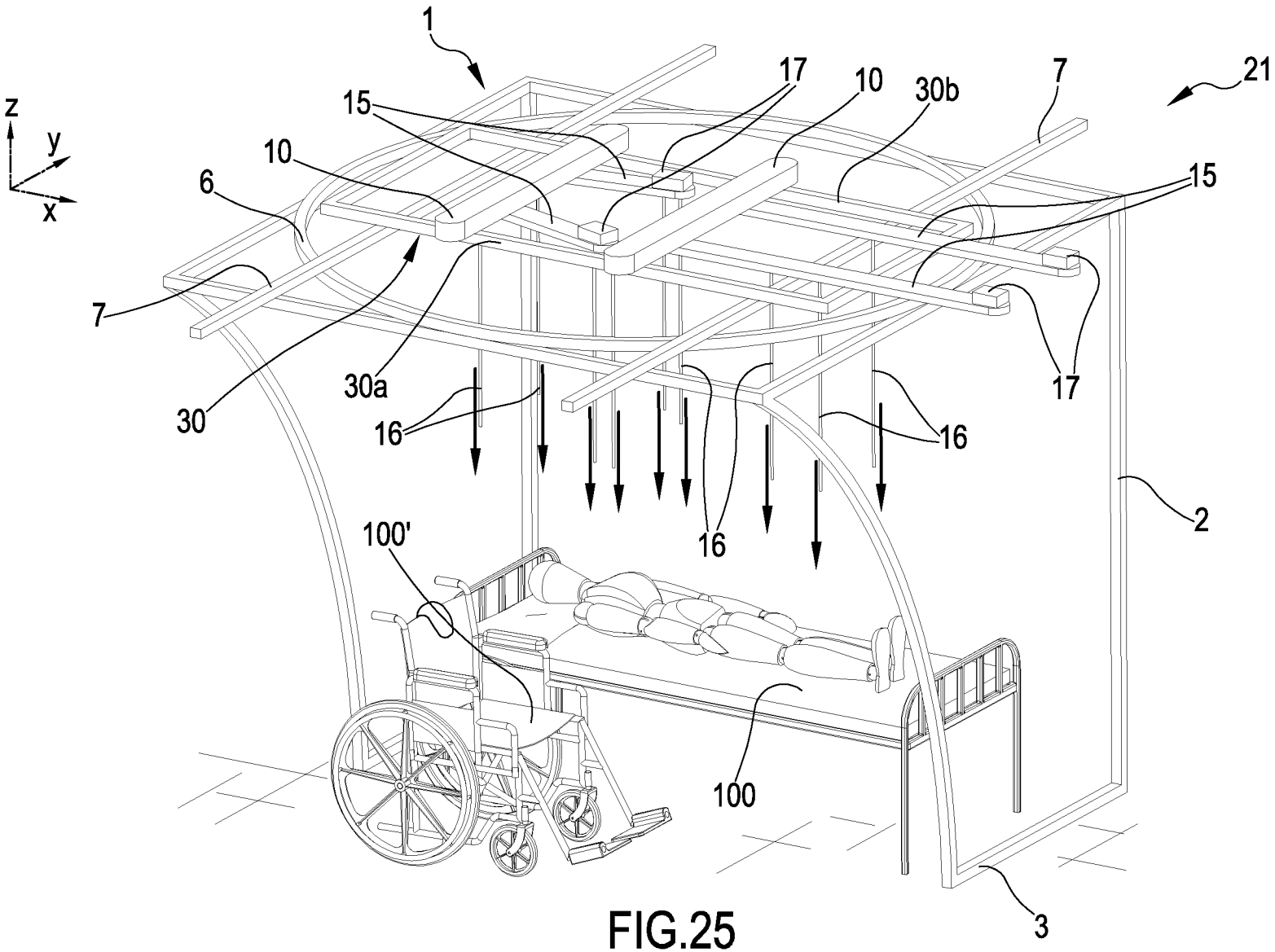
FIG. 25 shows a mover device in accordance with a further embodiment of the concepts herein arranged above a bed.

In accordance with an additional embodiment illustrated in FIG. 25, the mover device 1 can include a slide 30 configured for moving translationally along the y axis. With reference to such embodiment, the translating degrees of freedom of the components of the mover device 1 are referred to the cartesian axes comprising the x, y, and z axes shown in FIG. 25 and with reference to the rotational position assumed by the operating element 6 in FIG. 25. Assuming such cartesian axes integral with the operating element 6 in its rotation, such degrees of freedom remain unchanged even upon rotation of the operating element 6. The slide 30 engages the operating element 6 and is configured for rotating integrally with the operating element 6. Such slide 30, which translates on rails 7 parallel and respectively opposed with reference to their arrangement on the operating element 6, comprises in turn two auxiliary rails 30*a*, 30*b* along which two support cross-members 10 translate. The support cross-members 10 engage such slide 30 and are configured for translating independently along said auxiliary rails 30*a*, 30*b* along the x axis. Since the support cross-members 10 engage the slide 30, the translation of the slide 30 along they axis entails an integral translation of the support cross-members 10 along the y axis. Obviously, there might be alternatively provided one support cross-member 10 only or a plurality of support cross-members 10. Each support cross-member 10 bears a pair of swing arms 15, each of which bears a respective support element 16. Obviously, the number of swing arms 15 to be equipped might differ; substantially, there might be provided one swing arm 15 only for each support cross-member 10 or a plurality of swing arms 15 for each support cross-member 10. Each swing arm 15 is configured for rotating with respect to the support cross-member and bears in turn a fourth mover 17, arranged in correspondence with an end thereof and configured for moving a respective support element 16 at least in a vertical translational movement, and in particular to get closer to the installation 100, 100' and to move away from the installation 100, 100'.

The mover device 1 can also comprise a plurality of housing and gripping elements 18 to house and grip parts and/or joints of a patient's body (see FIG. 8). The mover device 1 being in an operating configuration, each housing and gripping element 18 engages and is supported by a respective support element 16 and is configured for being moved, and specifically for getting closer to and/or moving away from the installation 100, 100', thus at least partially modifying the position of a patient in the space. Also, the housing and gripping elements 18 are configured for operating in co-operation with the support elements 16 in moving, and in particular in at least partially changing the position of, lifting, and/or lowering parts of a patient's body or of the patient himself/herself with respect to the installation 100, 100'.

In one variant, the mover device 1 comprises at least one housing and gripping element 18' configured for operating at least between a rest condition and a grip condition. Optionally, the mover device 1 comprises a plurality of housing and gripping elements 18' only. One housing and gripping element 18' will be described below for ease of reference. A housing and gripping element 18' can substantially assume the shape of a band configured for being put around a part and/or a joint of a patient's body and/or a whole patient's body to make it possible to move it (see FIGS. 14 through 22). However, it is worth emphasizing that a band is just one of the possible embodiments of the housing and gripping element 18'.

Another possible embodiment of the housing and gripping element 18' is, for instance, a noose which exploits the tension of the support elements 16 to exert a pressure onto a patient (as with happens in a common slip-knot). In such embodiment, the housing and gripping element 18' comprises internally thereto flexible elements which operate in such a way that the pressure on the parts of a patient's body is released whenever the support elements 16 are not tensioned (and consequently do not effect movements) on the parts of a patient's body.

In another embodiment, the housing and gripping element 18' can assume the shape of a "simple" noose to be tightened by using Velcro, geometrically studied and structured in such a way as not to slip down along a patient's body, yet not applying a too high pressure and/or problems which are physically (dangerous) for a patient's body.

In a further embodiment, the housing and gripping element 18' can assume the shape of a "global" sling configured for being almost entirely wound around a patient's body, operating on the basis of the same technical principle as described above (application of a pressure to parts of a patient's body) or on the principles and technical characteristics that will be described below.

In a rest condition, the housing and gripping element 18' can engage a part and/or joint of a patient's body, whereas in a grip condition the housing and gripping element 18' engages a part and/or joint of a patient's body. The housing and gripping element 18' is also configured for assuming an energized or stimulated condition in a grip condition. The housing and gripping element 18' assuming an energized or stimulated condition determines its transition from a rest condition to a grip condition. The housing and gripping element 18' is configured for assuming the energized condition upon an energization or stimulation coming from an operating device 22 or from a tension, construed as a traction force exerted onto the housing and gripping elements 18' by their respective support elements 16.

In order to make it possible a connection between the housing and gripping element 18' and the operating device 22, the housing and gripping element 18' is provided with a quick fastener 23. The operating device 22 is configured for being connected to the quick fastener 23 of the housing and gripping element 18' to provide an external energization or stimulation to the housing and gripping element 18'. In one embodiment not shown in the attached figures, the operating device 22 is integral with the housing and gripping element 18' or is a component part of the housing and gripping element 18'.

The housing and gripping element 18' is also configured and/or shaped for engaging a respective support element 16 so that it can be moved by it. In particular, in an engagement condition with the support element 16, the housing and gripping element 18' is also configured and/or shaped for being moved and/or moving translationally, namely for getting closer to or moving away from the health and/or medical and/or domestic and/or orthopaedic installation 100. Substantially, while engaging the support element 16, the housing and gripping element 18' is configured and/or shaped for at least partially modifying the position in the space of a patient (or of portions of his/her body) who is using the health and/or medical and/or domestic and/or orthopaedic installation 100. In particular, the housing and gripping element 18' is thus configured and/or shaped for moving, and in particular for at least partially changing the position of and/or lifting a patient with respect to the health and/or medical and/or domestic and/or orthopaedic installation 100 and is also configured and/or shaped for moving a patient, or parts of a patient's body, from a health and/or medical and/or domestic and/or orthopaedic installation 100 to a further health and/or medical and/or domestic and/or orthopaedic installation 100' arranged in proximity of the health and/or medical and/or domestic and/or orthopaedic installation 100.

Figure 17:
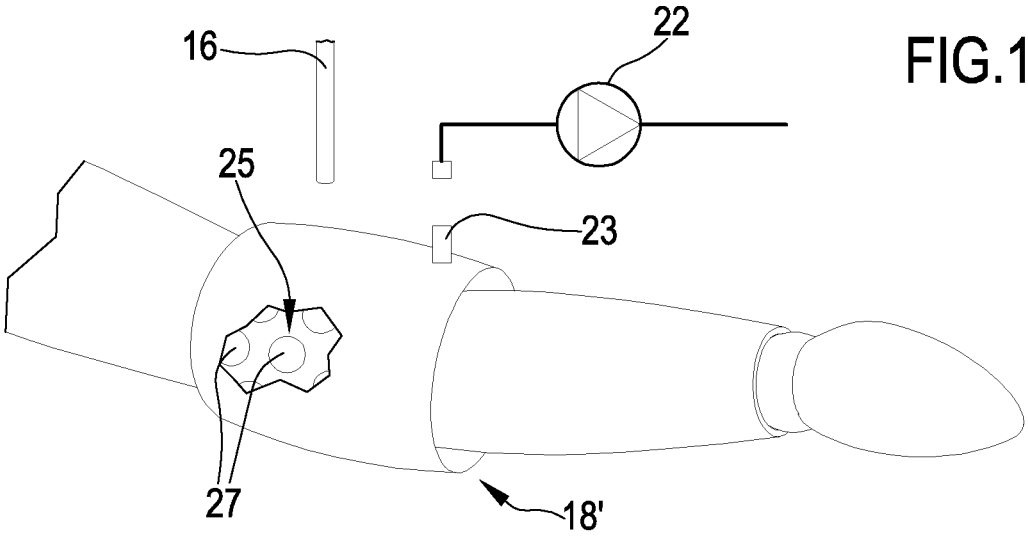
FIGS. 17 and 18 show a housing and gripping element in accordance with a third embodiment.
Figure 18:
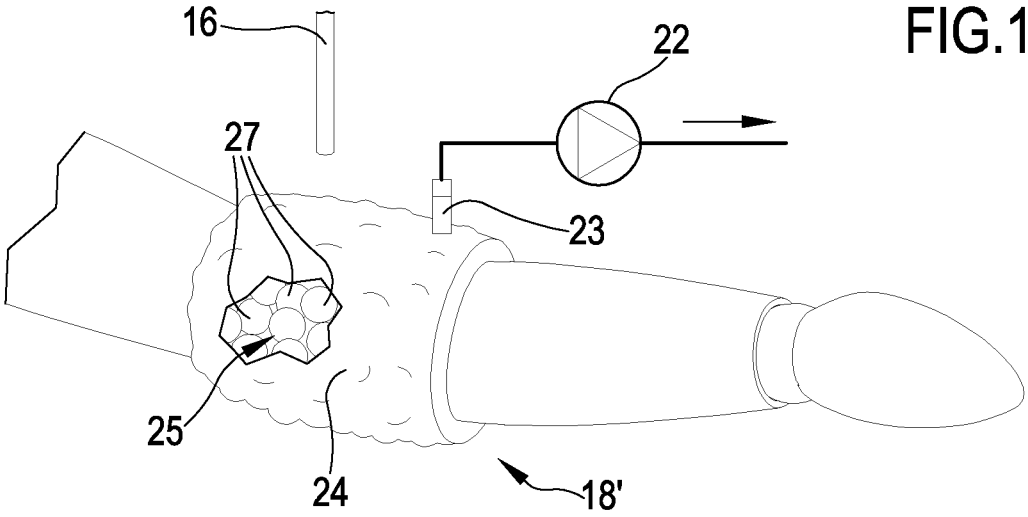

As shown for instance in FIGS. 17 and 18, the housing and gripping element 18' includes an outer shell 24 and an inner chamber 25 housed, arranged, or derived internally to the shell 24.

The inner chamber 25 is at least partially elastic and/or deformable. As seen in more details below, the inner chamber 25 being elastic and/or deformable makes it possible for the housing and gripping element 18' to switch from a rest condition to a grip condition and/or vice versa. The inner chamber 25 includes internally thereto a fluid, composition, or more generically any materials suitable for varying its own pressure and/or getting deformed and/or changing its own shape and/or volume upon an external energization or stimulation (coming from the operating device 22), as a function of the type of chamber 25. Four embodiments of the housing and gripping elements 18' are described below, each having a different type of chamber 25.

Figure 14:
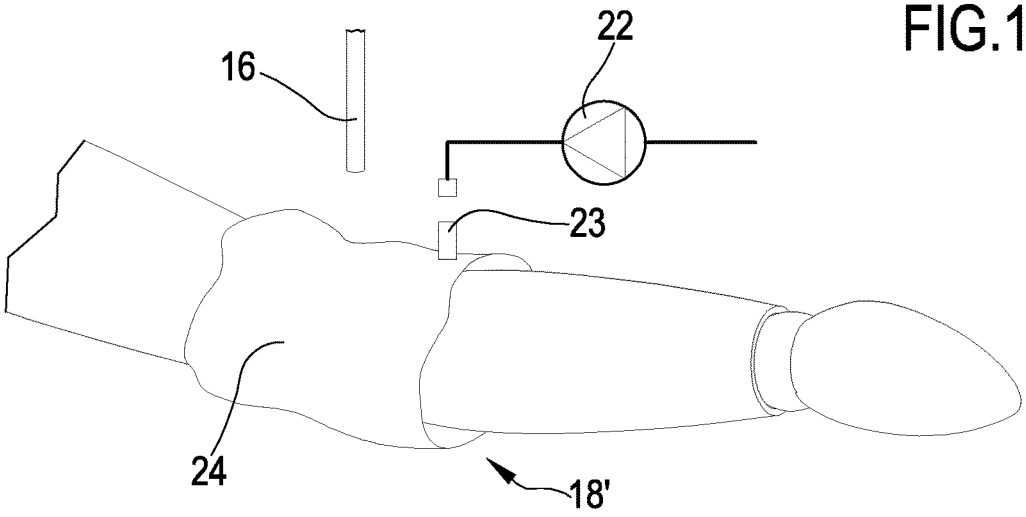
FIGS. 14, 15, and 16 show a housing and gripping element in accordance with a first embodiment.
Figure 15:
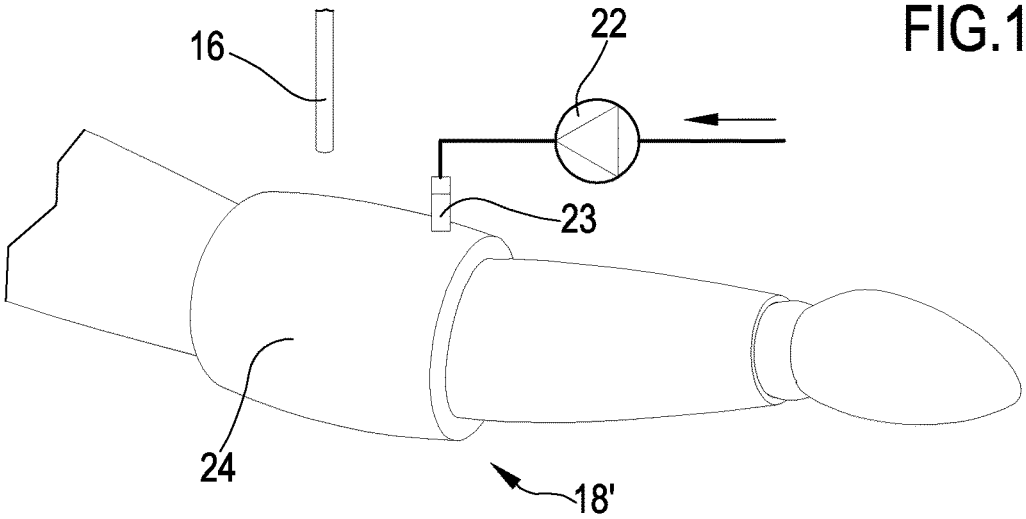
Figure 16:
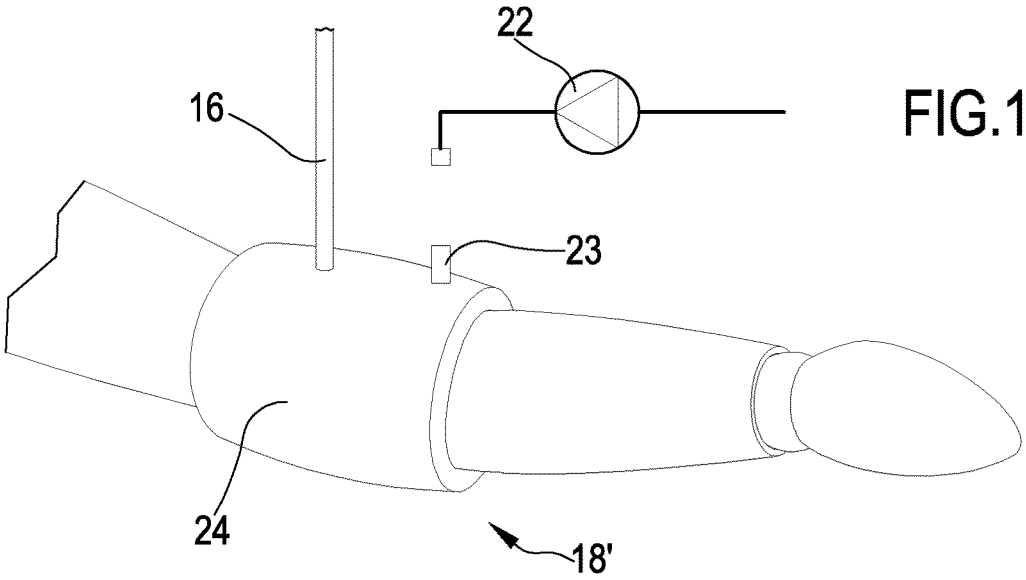

In a first embodiment of the housing and gripping element 18', shown in FIGS. 14 through 16, there is provided a housing and gripping element 18' provided with a pneumatic inner chamber 25. Preferably the inner chamber 25 of a pneumatic type contains, or is configured for containing, air or other gases. Alternatively, other fluids might be used instead of air. A pneumatic inner chamber 25 is configured for getting deformed and changing its own shape, for instance by increasing or decreasing a volume and/or internal pressure of its own (i.e. the volume and pressure of the fluid within the chamber 25), upon an external energization or stimulation coming from the operating device 22. In the case of a pneumatic chamber 25, the operating device 22 can be for instance a pump, a compressor, or a pressurized container or a pressure source (for instance coming from a distribution network) or similar devices configured for letting air or an alternative fluid enter the chamber and/or vary its pressure to determine a transition from a rest condition to a grip condition of the housing and gripping element 18'. In the first embodiment of the housing and gripping element 18', in a grip condition the housing and gripping element 18' features a pressure within the chamber 25 and a volume of the chamber 25 greater than the pressure within the chamber 25 and the volume assumed by the chamber 25 respectively in a rest condition of the housing and gripping element 18'.

FIG. 14 shows a housing and gripping element 18' in accordance with the first embodiment engaging a patient's arm, in a rest condition wherein it is disconnected from the operating device 22 and from the support element 16.

FIG. 15 shows a housing and gripping element 18' in accordance with the first embodiment engaging a patient's arm, in a condition wherein it is connected to the operating device 22 and is disconnected from the support element 16. Substantially, in the operating configuration shown in FIG. 15, the operating device 22 is making air enter the pneumatic chamber 25 (see the direction of the arrow in FIG. 15, going towards the quick fastener 23 of the housing and gripping element 18') and the chamber 25 is blowing up, thus increasing its own internal pressure and its own volume. In FIG. 15, the housing and gripping element 18' is effecting a transition from a rest condition to a grip condition. FIG. 16 shows a housing and gripping element 18' in accordance with the first embodiment engaging a patient's arm, in a grip condition wherein it is connected to the operating device 22 and to the support element 16 and is ready to move the patient's arm.

Figure 21:
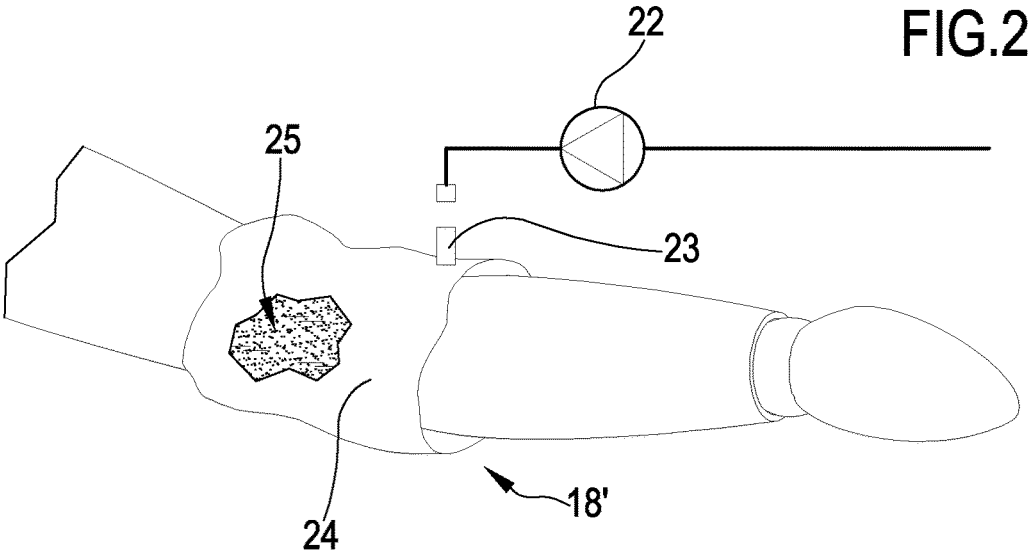
FIGS. 21 and 22 show a housing and gripping element in accordance with a second embodiment.
Figure 22:
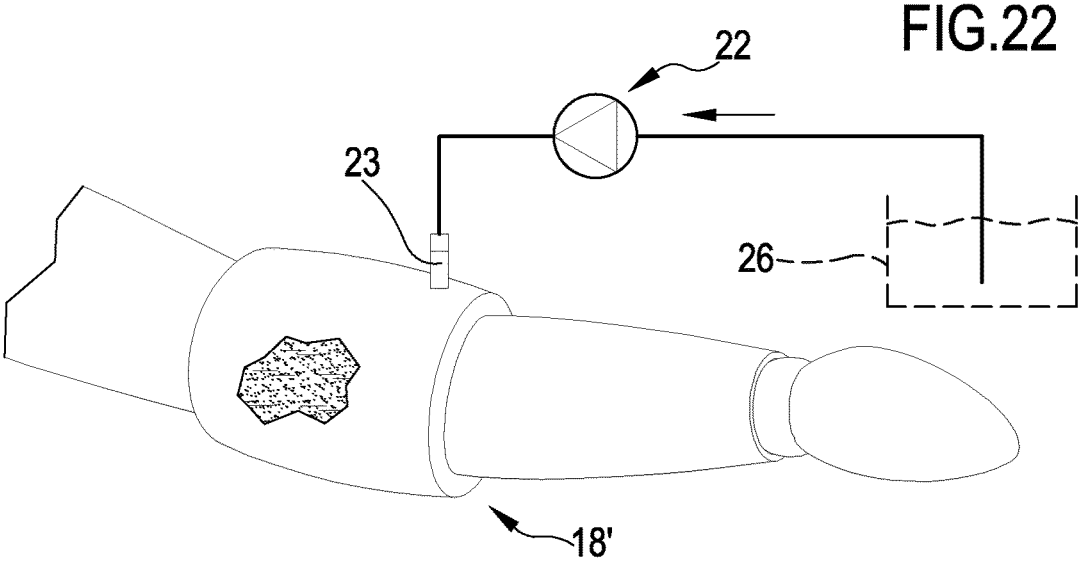

In a second embodiment of the housing and gripping element 18', shown in FIGS. 21 and 22, there is provided a housing and gripping element 18' provided with an inner chamber 25 of a hydraulic type. The hydraulic chamber 25 contains, or is configured for containing, an incompressible fluid.

FIG. 21 shows a housing and gripping element 18' in accordance with the second embodiment engaging a patient's arm, in a rest condition wherein it is disconnected from the operating device 22 and from the support element 16.

FIG. 22 shows a housing and gripping element 18' in accordance with the second embodiment engaging a patient's arm, in a condition wherein it is connected to the operating device 22 and is disconnected from the support element 16. Substantially, in the operating configuration shown in FIG. 22, the operating device 22 is making a fluid enter the hydraulic chamber 25 (see the direction of the arrow in FIG. 22, which goes towards the quick fastener 23 of the housing and gripping element 18') and the chamber 25 is blowing up, thus increasing its own volume and/or its own internal pressure. The fluid entering the chamber 25, or is going to enter it, can be for instance drawn from a tank 26 connected to or being part of the operating device 22. The tank 26 might be for instance installed above the patient; in this way, the fluid can exploit its own potential energy to feed the hydraulic chamber 25. Alternatively, the tank 26 might be installed below or at the same height with respect to the patient; in this way, a pump might be used to feed the fluid to the hydraulic chamber 25. Alternatively, the fluid input to the hydraulic chamber 25 might come from a water distribution network, for instance through a closed circuit with or without an expansion tank. In FIG. 22, the housing and gripping element 18' is substantially switching from a rest condition to a grip condition.

The hydraulic chamber 25 has a greater internal pressure in a grip condition than the internal pressure the chamber 25 has in a rest condition.

In a third embodiment of the housing and gripping element 18', shown in FIGS. 17 and 18, there is provided a housing and gripping element 18' provided with a deformable inner chamber 25 configured for operating at lower pressures than the atmospheric pressure. In this embodiment, the operating device 22 is configured for decreasing the pressure inside the chamber 25 down to a pressure lower than the ambient pressure, in particular in order to create a substantially vacuum condition inside the chamber. The operating device 22 might be, for instance, a vacuum pump, a pump set, a compressed air vacuum generator, a (large) membrane, or an element configured for increasing a volume hermetically connected to the housing and gripping element 18'. The chamber 25 includes internally thereto a plurality of deformable or non-deformable elements 27. The deformable or non-deformable elements 27, which might be, for instance, spheres as shown in FIG. 18, are configured for getting deformed or for uniting one against the other to grip the parts and/or joints of a patient's body and/or to lock his/her position in a grip condition of the housing and gripping element 18'.

FIG. 17 shows a housing and gripping element 18' in accordance with the third embodiment engaging a patient's arm, in a rest condition wherein it is disconnected from the operating device 22 and from the support element 16.

FIG. 18 shows a housing and gripping element 18' in accordance with the third embodiment engaging a patient's arm, in a condition wherein it is connected to the operating device 22 and is disconnected from the support element 16. Substantially, in the operating configuration shown in FIG. 18, the operating device 22 is making a fluid or air leave the chamber 25 (see the direction of the arrow in FIG. 22, going out towards the quick fastener 23 of the housing and gripping element 18') and chamber 25 is going flat, thus decreasing its own volume and its own internal pressure. The fluid going out from the chamber 25 determines a deformation of the shell 24 (see FIG. 18) and of the deformable elements 26, or a compaction of the non-deformable elements 26 which cannot slide any longer one above the other; in this way, the elements 26 can grip the parts and and/or joints of a patient's body in a grip condition of the housing and gripping element 18'. In FIG. 18, the housing and gripping element 18' is substantially going to switch from a rest condition to a grip condition.

In the third embodiment, the chamber 25 has a lower volume and internal pressure in a grip condition of the housing and gripping element 18' respectively as compared to a volume and to an internal pressure the chamber 25 has in a rest condition of the housing and gripping element 18'.

Figure 19:
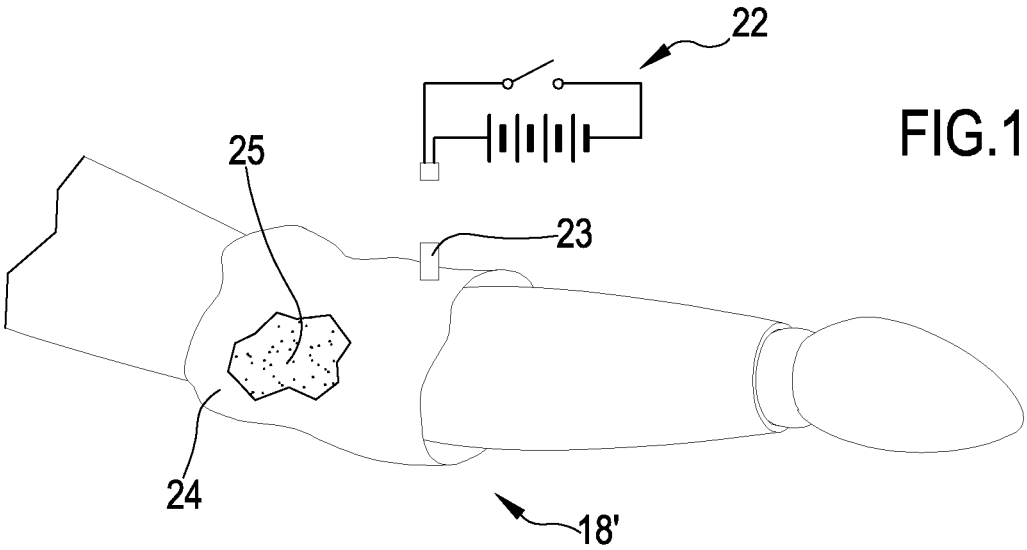
FIGS. 19 and 20 show a housing and gripping element in accordance with a fourth embodiment.
Figure 20:
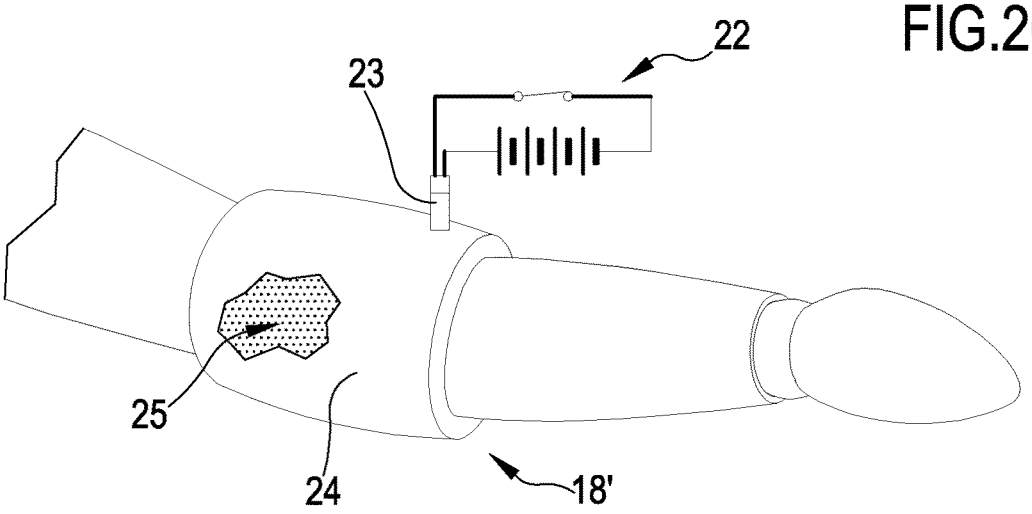

In a fourth embodiment of the housing and gripping element 18', shown in FIGS. 19 and 20, there is provided a housing and gripping element 18' provided with an inner chamber 25 containing electro-active materials (for instance polymers), or "smart" materials, which are configured for being electrically, chemically, or thermally energized or for changing their own shape in an electrical, chemical, or thermal energization condition. Alternatively or additionally, there can be provided "smart" materials inside the outer shell 24, As far as electro-active materials are concerned, they can be defined as materials having the characteristic of getting deformed whenever an electrical current is applied thereto.

The "smart" materials becoming electrically, chemically, or thermally energized by way of an appropriate operating device 22, determines a transition of the housing and gripping element 18' from a rest condition to a grip condition. The "smart" materials changing their shape substantially allows for the housing and gripping element 18' to grip parts and/or joints of a patient's body.

Examples of operating devices 22 for "smart" materials or for electro-active materials can include: electrical cables, temperature-difference operated devices, vibration-operated devices, ion-diffusion-in-electrolytic-substances-operated devices.

Preferably are the "smart" materials of an electro-active polymer (EAP) type (for instance ion-exchange membranes, gel polymers, etc.).

In the fourth embodiment, the quick fastener is of an electric type and/or is configured for interfacing to an operating device 22 of an electric type or configured for generating an electric field.

FIG. 19 shows a housing and gripping element 18' in accordance with the fourth embodiment engaging a patient's arm, in a rest condition wherein it is disconnected from the operating device 22 and from the support element 16.

FIG. 20 shows a housing and gripping element 18' in accordance with the fourth embodiment engaging a patient's arm, in a condition wherein it is connected to the operating device 22 and is disconnected from the support element 16. In the operating configuration shown in FIG. 20, the operating device 22 is substantially electrically energizing the electro-active materials contained in the chamber 25 to cause the housing and gripping element 18' to switch from a rest condition to a grip condition.

Figure 23:
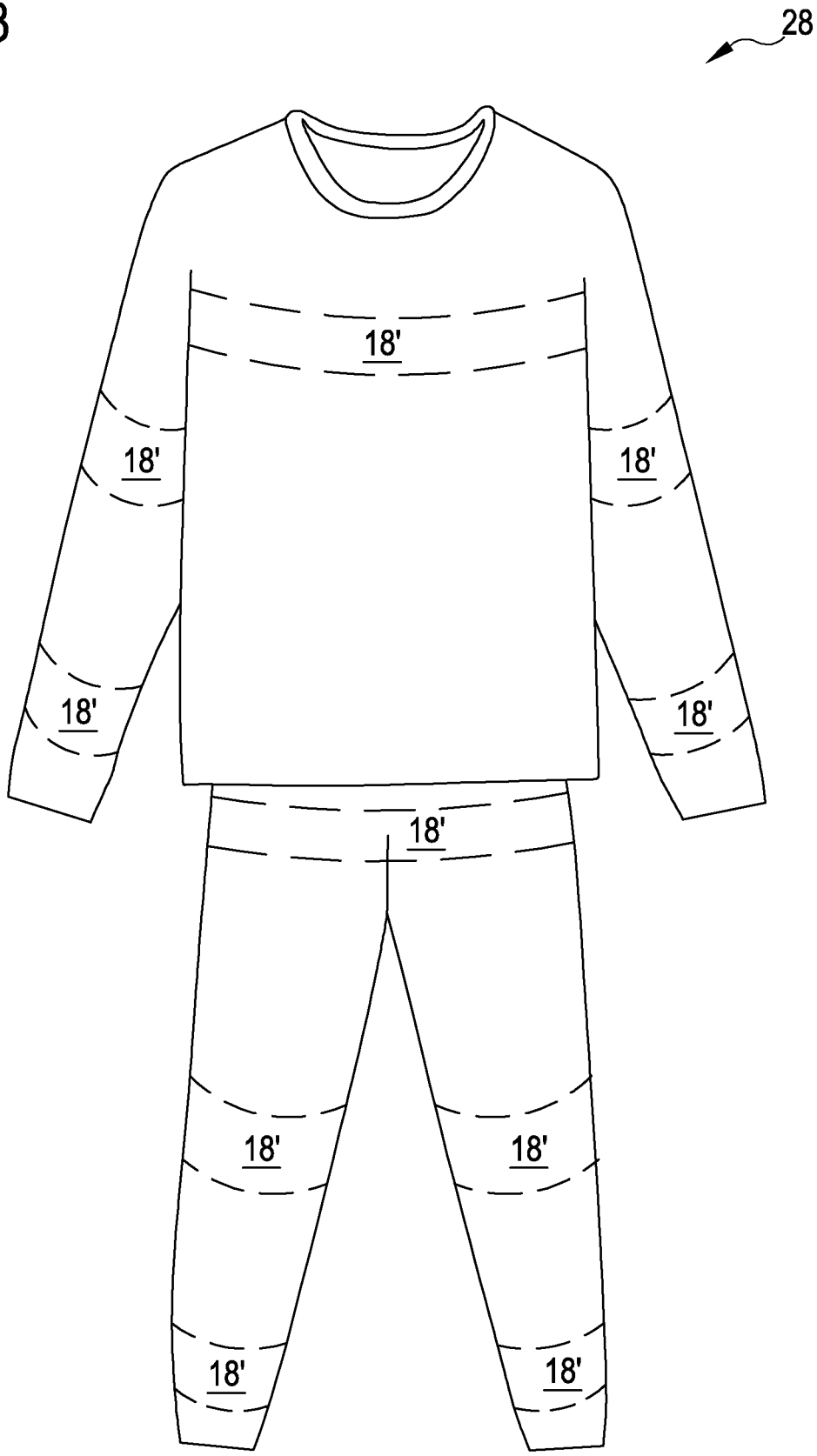
FIG. 23 shows a garment in accordance with an embodiment of the present invention.
Figure 24:
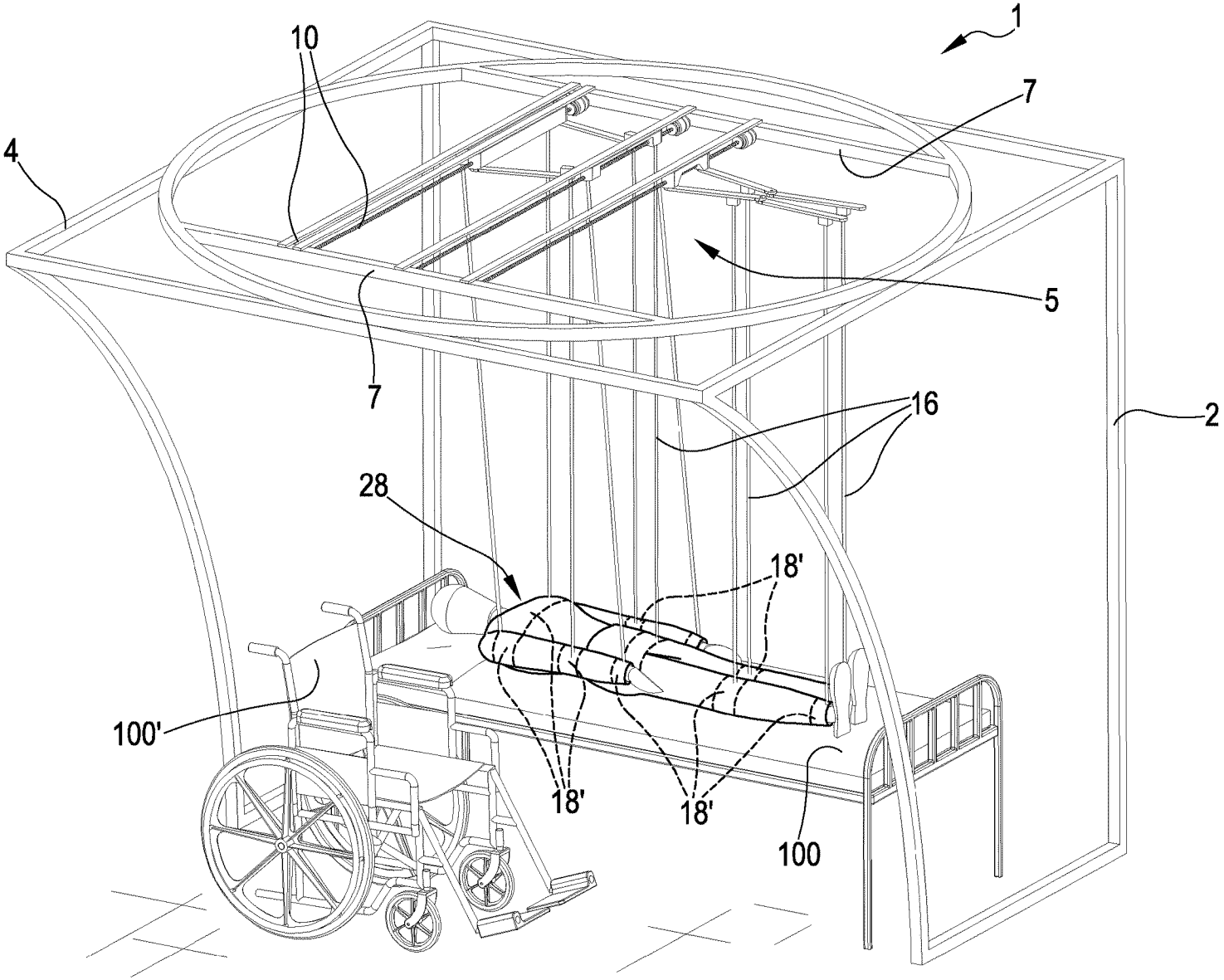
FIG. 24 shows a mover device in accordance with a further embodiment of the concepts herein arranged above a bed.

The mover device 1 possibly also include a garment 28 comprising one or more housing and gripping elements 18'. Preferably are the housing and gripping elements 18' integral with the garment 28. The garment 28 might be, for instance, a pyjama, a pair of trousers, a nightshirt/nightdress, a T-shirt, or an overall substantially incorporating the whole patient's body. A garment integrating a plurality of housing and gripping elements 18' is shown in FIG. 23. Preferably are the housing and gripping elements 18' of the garment 28 integrated into portions of the garment 28 intended for being arranged, in a condition wherein a patient wears the garment 28, in correspondence with or around portions and/or joints of a patient's body intended for being moved by way of the motor-driven operating portion 5 of the mover device 1. FIG. 24 shows a patient wearing the garment 28 of FIG. 23 who is going to be moved by way of the mover device 1.

In the operating conditions of the mover device 1, said structure of the mover device 1 creates a "virtual" operating area above the patient, internally to which the possible movements of the operating element 6, of the support cross-members 10, of the intermediate connection elements 12, and of the support elements 16 define a plurality of stability positions for a patient (or for parts of his/her body), which are selectively obtainable, preferably by way of interpolations. By stability points obtainable by way of interpolation (or interpolable stability points) we mean stability points reachable via a coordinated movement of the operating element 6, of the support cross-members 10, of the intermediate connection elements 12, of the swing arms 15, and/or of the support elements 16. The possible movements of the operating element 6, of the support cross-members 10, of the intermediate connection elements 12, of the arms 15, and/or of the support elements 16 take place inside said operating area, which can be better defined by making reference to three cartesian axes orthogonal to each other. Such cartesian axes is shown in figure N, and consists of the x, y, and z axes. The x and y axes are orthogonal to each other and define an operating plane, substantially corresponding to the plane on which the operating element 6 lays. The rotation of the operating element 6 with respect to the frame 2 takes place in said operating plane, or parallel to said operating plane. The translation of the support cross-members 10 and of the intermediate connection element 12 also takes place in the operating plane or parallel thereto. Conversely, as far as the z axis is concerned, it is to be said that it develops in a substantially vertical direction, orthogonal to the operating plane, and defines, together with a sheaf of vertical directions parallel thereto, a sheaf of directions along which corresponding support elements 6 are moved, by way of respective fourth movers 17. Coming back to the previously mentioned stability positions for a while, it is worth emphasizing that the motor-driven operating portion 5 and the control unit 19, and consequently the mover device 1 as a whole, are configured for controlling an almost unlimited number of stability positions internally to said operating area. Such stability positions can just be obtained by interpolation of the possible movements of the movable components 6, 10, 12, 15, 15', 16 which, as previously described, are possibly translational movements along the x, y, and z axes, rotation movements with respect to the x, y, and z axes, and roto-translation movements with respect to the x, y, and z axes. Substantially, the control unit 19 is configured for imposing a specific law of motion to each movable component 6, 10, 12, 15, 15', 16 of the motor-driven operating portion 5.

Here below it is explained how stability positions are obtained by interpolation. The control unit 19 knows at least some values (for instance at least the extreme values and one intermediate value, or in any case at least two values) of the law of motion of each movable component 6, 10, 12, 15, 15', 16 and is capable of deriving, through a computation, the values of the law of motion (which is substantially a function and/or an algorithm) internally to a range in which just few values only are known. A specific position of the movable component whose law of motion is "being analyzed" corresponds to every value of the law of motion. Since the control unit 19 is capable of computing any stability points, any point internal to the operating area makes-up a stability point of the system, and consequently it represents a possible stable position of parts of a patient's body or of the patient himself/herself. It is also to be said that every stability point is reachable by way of a plurality of different operating configurations, which include different spatial arrangements or positionings of the movable components 6, 10, 12, 15, 15', 16.

Figure 10:
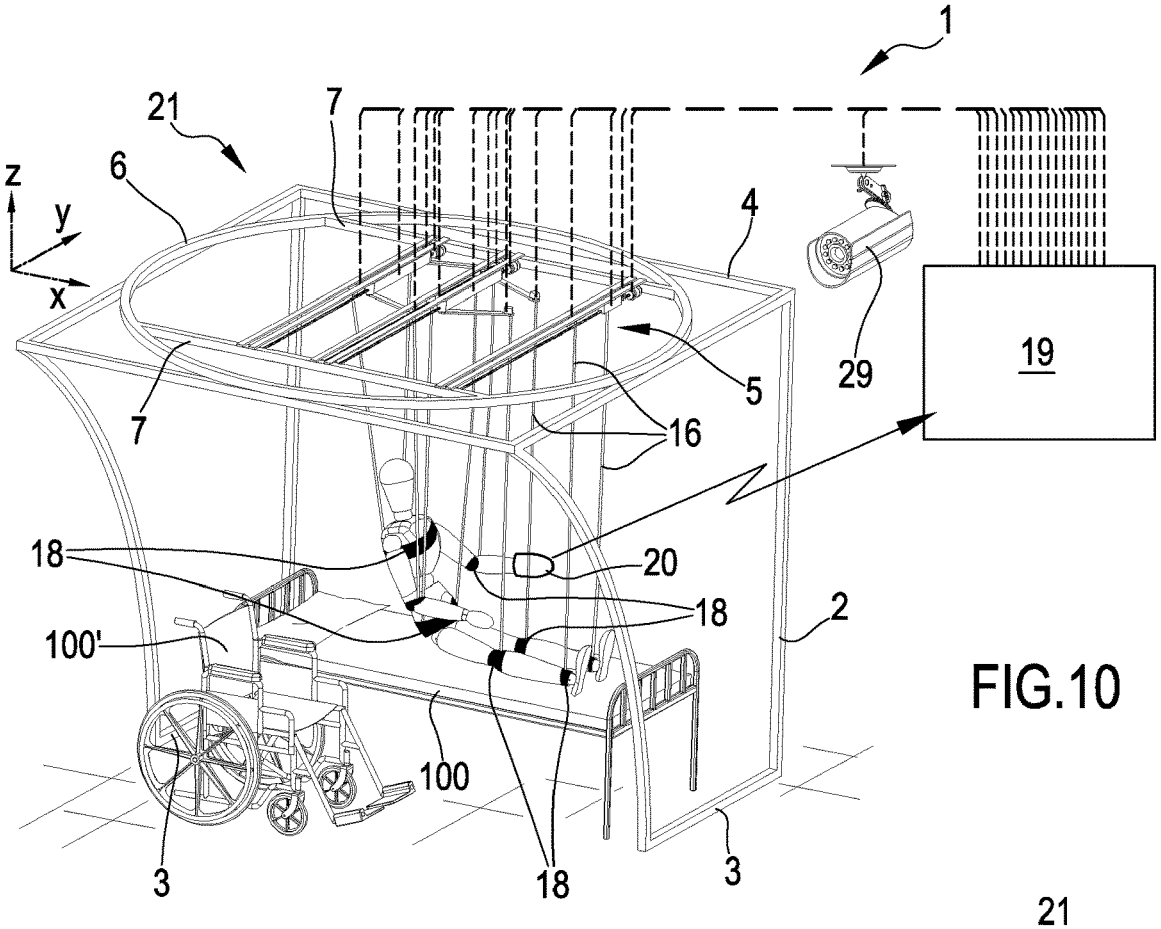
FIG. 10 shows the mover device of FIG. 9 in an operating configuration, upon lifting a patient, who supplies positioning instructions to the control unit of the mover device via an accessory in the form of a glove worn in his/her left hand.
Figure 11:
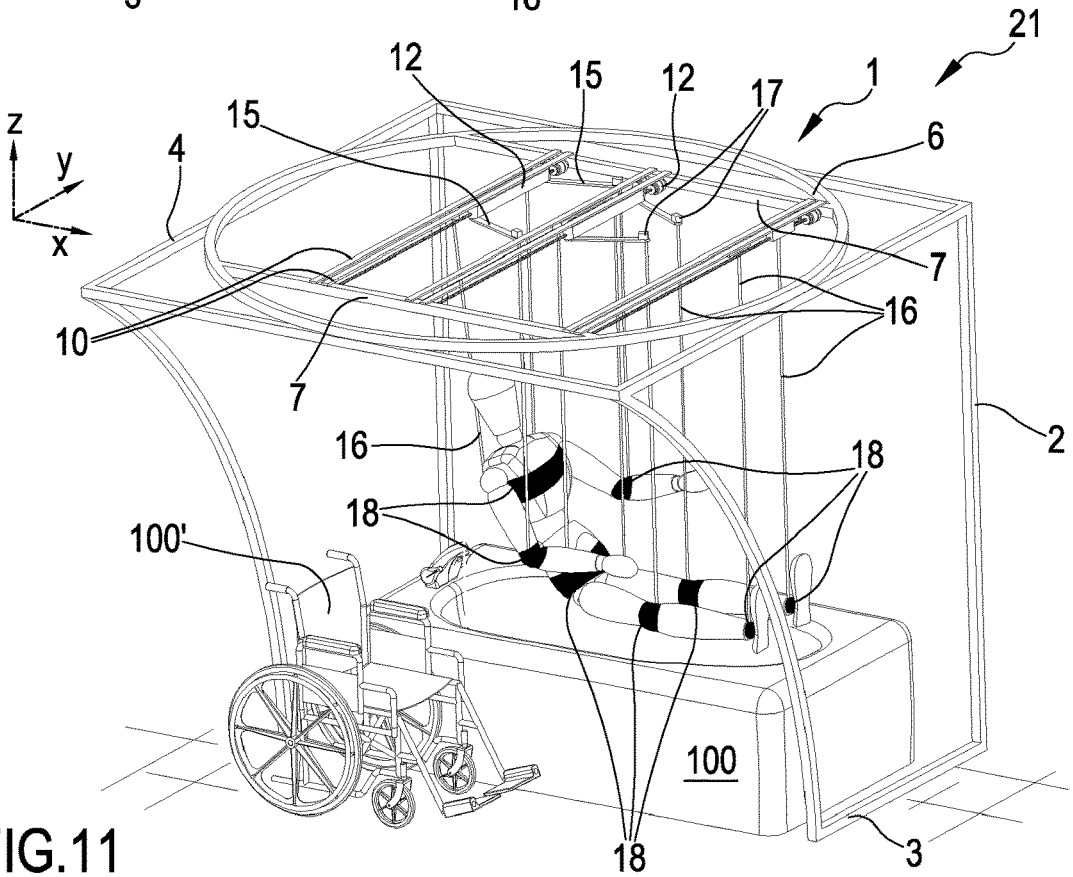
FIG. 11 shows a mover device in accordance with an embodiment of the concepts herein arranged above a bathtub and in an operating configuration, upon lifting a patient.

In order to control the coordination of said movable components of the motor-driven operating portion 5, the mover device 1 comprises a control unit 19 (see FIG. 10) specifically configurable and programmable for said purpose. Advantageously is the control unit 19 a centralized control unit, i.e. one control unit pre-set, configured, and programmed for controlling and managing the movements of the operating element 6, of the support cross-members 10, of the intermediate connection elements 12, of the swing arms 15, 15', of the support elements 16, and of all fourth movers 17, 17' (in that they are integral with the swing arms 15, 15' respectively). FIG. 10 schematically shows the connections between each movable component 6, 10, 12, 15, 15', 16 of the motor-driven operating portion 5 and the control unit 19. Such connections, which are preferably of a wireless type (but they might even be wired connections, in accordance with a variant not shown in the attached figures), make it possible an interaction and communication between the control unit 19 and the movable components 6, 10, 12, 15, 15', 16. As an alternative to having one centralized control unit 19, there might be provided a plurality of dedicated control units, each of which is responsible for controlling and managing the movements of at least one movable component 6, 10, 12, 15, 15', 16 of the motor-driven operating portion 5; however, such embodiment is not shown in the attached figures. Coming back to the embodiment shown in FIG. 10, whereby one centralized control unit 19 is used, it is necessary to highlight that the control unit 19 is configured for controlling and/or programming the movements of the operating element 6, of the support cross-members 10, of the intermediate connection elements 12, of the swing arms 15, 15', of the support elements 16, and of the fourth movers 17, 17' (in that they are integral with the swing arms 15, 15' respectively) so as to allow for moving, and in particular at least lifting and/or at least partially changing the position of or re-positioning parts of a patient's body or of a patient himself/herself with respect to the installation 100, 100'. In particular, the control unit 19 is configured for communicating, via at least one link or a wired or wireless connection, with an accessory 20 operatable by a patient himself/herself, such as a remote control or a wearable accessory, or any other device that enables humans to communicate and/or to interface to the control unit 19 of the mover device 1, by a patient or by a person committed to assist a patient, or via a software or a dedicated mobile application installed or operating in a processor, computer, or mobile device, such as a smartphone, tablet, or laptop. Also, the control unit 19 is configured for being managed and controlled wirelessly by said accessory 20, software, or mobile application. In one variant, the control unit 19 can be configured for being controlled via a voice command, for instance by a patient or by an appointed person having the skill necessary to perform such task. For this purpose, the mover device 1 possibly comprises a voice recognition unit (not shown in the attached figures) which allows to translate voice inputs into a "machine language" understandable by the control unit 19, which in turn processes and translates such received inputs into commands for co-ordinately moving said movable components 6, 10, 12, 15, 15', 16 of the motor-driven operating portion 5, in order to enable parts of a patient's body, or the patient himself/herself, to assume a desired position.

The control unit 19 can also be provided with a detection device for detecting the positions of parts of a patient's body, such as for instance 3D or infrared cameras and/or sensors, in order to optimize and achieve a better safety for the patient himself/herself, to collect and/or store in a storage data intended for being used by a specialized staff, either in real time and/or recorded and/or remotely, and to have a real time monitoring, control, and feedback (be it a properly said feedback or not) by the control unit 19.

Concerning software and/or mobile application, it is to be said that they are programmable, configurable, and customizable, for instance by a physiotherapist, a doctor, or an appointed person having the necessary skill for this purpose, on the basis of the specific movement requirements (or movement compensation) of each individual patient. Also, the software and/or mobile application can be configured to make it possible to create, modify, and save appropriate physiotherapic movement and/or support programs, specific to every patient, in a storage.

The concepts herein also refer to a system 21 comprising a mover device 1 of the previously described type and an accessory 20 of the type briefly described above, such as a remote control, a wearable accessory, or a device whatsoever which enables humans to communicate and/or to interface to the control unit 19 of the mover device 1, or a processor, computer, or mobile device. The accessory 20 is configurable and, in the operating conditions of the mover device 1, configured for controlling the control unit 19 in a wired mode or wirelessly, so as to allow for moving, and in particular at least lifting or re-positioning a patient with respect to the installation 100, 100'. Advantageously is said accessory a device (for instance a glove, wrist, or sleeve) wearable by the patient himself/herself or any other devices that enable humans to communicate and/or to interface to the control unit 19 of the mover device 1, or alternatively by a doctor, assistant, or authorized person. FIG. 10 just shows a patient wearing an accessory 20 in the form of a glove, upon wirelessly ordering to the control unit 19, the movement to be imposed to the operating element 6, to the support cross-members 10, to the intermediate connection elements 12, to the swing arms 15 and/or to the support elements 16 in order to leave the bed. In accordance with an embodiment, the accessory 20 can be of a movement recognition type; in such embodiment, the control unit 19 is configured for translating specific movements of the wearable accessory, or any other devices that enable humans to communicate and/or to interface to the control unit 19 of the mover device 1, into specific movements of the operating element 6, of the support cross-members 10, of the intermediate connection elements 12, of the swing arms 15, and/or of the support elements 16, and/or into specific patient movement programs (for instance programs stored in a storage).

The mover device 1 can optionally comprise a device 29 for recognizing a patient's position. Such device 29 is configured for recognizing a position of a patient in real time and are connected to the control unit 19. In particular, the device 29 for recognizing a patient's position is configured for recognizing the position of a patient in real time, even under or across elements and/or obstacles interposed between the patient and the device 29 used to recognize a patient's position. Such elements and/or obstacles interposed between a patient and the device 29 used to recognize a patient's position can include, for instance, blankets, pillows, or garments.

In the embodiment wherein the mover device 1 includes a device 29 for recognizing a patient's position, the control unit 19 can be configured for receiving information relevant to the patient's position from the device 29 used to recognize a patient's position and for processing the information coming from the device 29 used to recognize a patient's position. Also, the control unit 19 can be configured for operating at least one support element 16 and/or at least one housing and gripping element 18, 18' in such a way as to moving a patient or to pre-set a patient and/or the mover device 1 to move a patient as a function of the information coming from the device 29 used to recognize a patient position. Preferably the device 29 used to recognize a patient position comprises at least one thermal imaging camera or a plurality of thermal imaging cameras.

The mover device 1 can optionally comprise a device configured for facilitating the connection and disconnection between a patient and the mover device 1 and/or for making the connection between the mover device 1 and a patient take place autonomously and/or automatically without a further person or health operator giving help. In one embodiment, the device configured for facilitating the connection and disconnection between a patient and the mover device comprises, correspond to, or constitute the device 29 used to recognize a patient's position.

The concepts herein also include a procedure for moving patients and/or persons with reduced mobility, comprising a first step of pre-setting a mover device 1 like that previously described. This procedure also includes the step of engaging at least one housing and gripping element 18, 18' with a part and/or joint of a patient's body.

In the embodiment of the procedure that includes housing and gripping elements 18', the procedure includes a step of determining a transition of the housing and gripping element 18' from a rest condition to a grip condition, optionally by way of the operating device 22. The step of effecting a transition of the housing and gripping element 18' from a rest condition to a grip condition possibly includes, for instance, the step of operating the operating device 22 as shown in FIGS. 15, 22, 18, and 20, which concerns said step of transition of the housing and gripping element 18' of the first, second, third, and fourth embodiments respectively.

Also, the procedure possibly comprises the step of connecting at least one support element 16 to the housing and gripping element 18, 18' in such a way as to firmly engage and make the housing and gripping element 18, 18' integral with the support element 16. This procedure might also include a step of operating, by way of the control unit 19, the support element 16 in such a way as to allow for moving, and in particular at least lifting and/or at least partially changing the position of or re-positioning, that part and/or joint of the patient's body which is engaged by the housing and gripping element 18, 18' with respect to the health and/or medical and/or domestic and/or orthopaedic installation 100, or with respect to a further health and/or medical and/or domestic and/or orthopaedic installation 100' arranged in proximity of the health and/or medical and/or domestic and/or orthopaedic installation 100.

In the embodiment of the procedure that include housing and gripping elements 18', the procedure possibly also includes a step of stimulating or energizing the inner chamber 25 or the outer shell 24 in such a way as to increase or decrease a volume and/or an internal pressure of the chamber 25 and/or to make said inner chamber 25 get deformed and/or change its own shape, or to modify the external circumference or outer diameter of the housing and gripping elements 18', in accordance with the modes previously described with respect to the embodiments according to FIGS. 14 through 22.

In one embodiment, the step of connecting the support element 16 to the housing and gripping element 18' follows the step of stimulating or energizing the inner chamber 25, as (with reference to the first embodiment of the housing and gripping element 18') in the sequence of steps of the procedure shown in FIGS. 14, 15, and 16. In particular, the step of connecting the support element 16 to the housing and gripping element 18' might be implemented, the operating device 22 being still connected to the quick fastener 23 of the housing and gripping element 18', or after disconnecting the operating device 22 from the quick fastener 23 (see FIG. 16).

In a variant, the step of connecting the support element 16 to the housing and gripping element 18' precedes the step of stimulating or energizing the inner chamber 25.

ADVANTAGES OF THE INVENTION

The concepts herein provide a mover device 1 and a system 21 that feature the following advantages as compared to the technical solutions of the known art.

The mover device 1 and the system 21 here proposed are first of all controlled and operated by a patient himself/herself and/or by a person appointed to monitor the patient's conditions; also, they can be, either additionally or alternatively, automated, for a local or remote control by persons appointed to monitor the patient's conditions.

Also, the mover device 1 and the system 21 here proposed are reliable and effective in their operation.

The mover device 1 in accordance with the concepts herein provides functional and active movement of parts of a patient's body or of a patient himself/herself in their entirety. Such movements, especially for elderly and/or disabled patient, are very advantageous in that they are capable of preventing sores and hematomas from forming, due to an extended permanence in a given rest position. Also, the control unit 19 makes it possible to achieve a high accuracy in spatially positioning the movable components 6, 10, 12, 15, 15', 16 of the motor-driven operating portion 5, and consequently it provides for a multiplicity of stability positions to the parts of the patient's body that are moved by way of the elements 17, 18. Advantageously are such positions computed by the control unit 19 itself, by way of an interpolation of the motion functions of the movable components 6, 10, 12, 15, 15', 16, while guaranteeing high reliability and simultaneously allowing for a real time monitoring of the patient's physical and/or comfort conditions.

In addition, the mover device 1 and the system 21 in accordance with the invention, being it possible for them to be controlled by a user himself/herself in accordance with the previously described modes, are capable of rendering patients with reduced mobility at least partially independent, at least for that which concerns displacement from an installation 100, 100' such as a bed, a wheelchair, or a seat in general, and vice versa.

Also, the mover device provides for a firm grip on a patient and a safe, effective, and accurate movement of the patient. Also, thanks to the housing and gripping element 18' described above, patient's movements are effected by patients painlessly.

The invention claimed is:

1. A mover device for the body of patients and/or persons with reduced mobility, suitable and configured for being operationally positioned above or close to a health and/or medical and/or domestic and/or orthopedic installation, be it movable or fixed, the mover device comprising:

a frame comprising a binding portion configured for positioning said mover device in a stable equilibrium above or close to said health and/or medical and/or domestic and/or orthopedic installation;

a motor-driven operating portion, supported by said frame on an upper surface or portion of the frame and at least partially overhanging, or arranged close to said health and/or medical and/or domestic and/or orthopedic installation, said motor-driven operating portion comprising a plurality of support elements, cables, belts, or elongate traction elements, each being movable according to at least one degree of freedom and/or along at least one axis in the space and being configured for:

at least partially or fully supporting the weight of a patient, being moved, in particular translationally and/or rotationally, moving at least one respective part of the patient's body according to said at least one degree of freedom and/or along said at least one axis with respect to said health and/or medical and/or domestic and/or orthopedic installation, and/or moving parts of said patient's body in order to at least partially modify the position of the patient in the space and/or to make parts of the patient's body get closer to the health and/or medical and/or domestic and/or orthopedic installation and/or to make them move away from the health and/or medical and/or domestic and/or orthopedic installation;

a control unit configured for controlling and/or programming the movements of said support elements, cables, belts, or elongate traction elements so as to make it possible to move, and in particular to at least lift and/or change the position of or to at least partially reposition parts of the patient's body or the patient himself/herself with respect to said health and/or medical and/or domestic and/or orthopedic installation, or with respect to a further health and/or medical and/or domestic and/or orthopedic installation arranged in proximity of said health and/or medical and/or domestic and/or orthopedic installation;

an operating element supported by the frame and configured for at least rotating with respect to the frame co-planar with respect to said upper surface or portion of the frame or in a plane parallel to said upper surface or portion of the frame, the support elements, cables, belts, or elongate traction elements being rotationally integral with and engaging, either directly or indirectly, said supporting elements, cables, belts, or elongate traction elements to rotate integrally with the operating element; and one or several support cross-members supported by said operating element, each support cross-member featuring a main direction of development, at least one of the plurality of support elements, cables, belts, or elongate traction elements movably engaging a respective support cross-member so as to be able to translationally move at least along the main direction of development of said support cross-member, wherein said one or several support cross-members engage said operating element by way of at least one guide rail or at least one pair of guide rails, so as to be rotationally integral with the operating element and to be able to translationally move while engaging said at least one guide rail or said at least one pair of guide rails.

2. The mover device according to claim 1, wherein each support element, cable, belt, or elongate traction element is capable of getting closer to and/or going away from, preferably by way of a vertical translational movement in either direction, between said upper surface or portion of the frame and the health and/or medical and/or domestic and/or orthopedic installation, in order to make it possible an appropriate positioning, by way of a translational, rotational, and/or roto-translational movement, of said at least one respective part of the patient's body.

3. The mover device according to claim 1, further comprising two arms mounted on a support cross-member, either directly or indirectly by way of an intermediate connection element slidable along said support cross-member, said arms being configured for rotating and/or moving translationally with respect to said support cross-member.

4. The mover device according to claim 1, wherein said support elements, cables, belts, or elongate traction elements and said one or several support cross-members are supported by the frame and arranged in the space so as to form an operation area wherein the possible movements of said support elements, cables, belts, or elongate traction elements of said one or several support cross-members, and/or of said operating element define a plurality of stability positions for the patient or for parts of the patient's body, being it possible to select and/or interpolate said stability positions by way of said control unit.

5. The mover device according to claim 1, wherein said control unit is configured for communicating via a wired connection or wirelessly with, and/or being operated and controlled wirelessly by:

an accessory, such as a remote control or a wearable accessory, and/or by a software and/or a dedicated mobile application installed and/or configured for operating on a processor, computer, or mobile device.

6. The mover device according to claim 1, also comprising at least one housing and gripping element for housing and gripping parts and/or joints of said patient's body, said housing and gripping element being engageable or engaged to a respective support element, cable, belt, or elongate traction element and being configured for:

a. being moved and/or getting closer to and/or going away from the health and/or medical and/or domestic and/or orthopedic installation and consequently for at least partially modifying the position in the space of the patient who uses said health and/or medical and/or domestic and/or orthopedic installation, b. moving the position of the patient with respect to said health and/or medical and/or domestic and/or orthopedic installation, and in particular at least performing an at least partial change of position and/or lifting thereof, and/or c. moving the patient, or parts of the patient's body, from a health and/or medical and/or domestic and/or orthopedic installation to a further health and/or medical and/or domestic and/or orthopedic installation arranged in proximity of said health and/or medical and/or domestic and/or orthopedic installation.

7. The mover device according to claim 1, also comprising at least one housing and gripping element to house and grip parts and/or joints of said patient's body, said at least one housing and gripping element being able to engage or engaging a respective support element cable, belt, or elongate traction element, the housing and gripping element being configured for operating at least between:

a rest condition wherein it can engage a part and/or joint of said patient's body, a grip condition wherein said at least one housing and gripping element engages a part and/or joint of said patient's body.

8. The mover device according to claim 7, wherein said at least one housing and gripping element is configured and/or shaped for engaging a respective support element, cable, belt, or elongate traction element so that it can be moved by said support element, cable, belt, or elongate traction element in an engagement condition with said support element, cable, belt, or elongate traction element, said at least one housing and gripping element being also configured for:

a. being moved and/or translationally moving in both directions, thereby providing the capability of getting closer to and/or moving away from the health and/or medical and/or domestic and/or orthopedic installation and consequently for at least partially modifying the position in the space of the patient using said health and/or medical and/or domestic and/or orthopedic installation, b. effecting the movement, and in particular at least partially changing the position of and/or lifting a patient with respect to said health and/or medical and/or domestic and/or orthopedic installation, and/or c. effecting the movement of a patient, or of parts of a patient's body, from a health and/or medical and/or domestic and/or orthopedic installation to a further health and/or medical and/or domestic and/or orthopedic installation arranged in proximity of said health and/or medical and/or domestic and/or orthopedic installation.

9. The mover device according to claim 7, wherein said at least one housing and gripping element includes an inner chamber:

configured for getting deformed and/or changing its shape, by increasing or decreasing a volume and/or an internal pressure, upon an external energization or stimulation, and/or containing, or configured for containing, a fluid or a composition suitable for varying its pressure and/or getting deformed and/or changing its shape and/or volume upon an external energization or stimulation.

10. The mover device according to claim 9, wherein said at least one housing and gripping element includes a quick fastener, the mover device also comprising an operating device configured for being connected to said quick fastener to provide said external energization or stimulation to said at least one housing and gripping element.

11. The mover device according to claim 10, wherein said operating device is integral with said at least one housing and gripping element.

12. The mover device according to claim 9, wherein said inner chamber is an elastic and/or deformable chamber configured for having a greater volume in a grip condition of said at least one housing and gripping element as compared to the volume that said chamber has in a rest condition of said at least one housing and gripping element.

13. The mover device according to claim 9, wherein said chamber:

is a pneumatic chamber and contains or is configured for containing air, or is a hydraulic chamber and contains, or is configured for containing an incompressible fluid, the chamber having a greater internal pressure in a grip condition as compared to an internal pressure that said chamber has in a rest condition.

14. The mover device according to claim 10, wherein said inner chamber is deformable, the operating device being configured for decreasing the pressure inside the chamber down to a pressure lower than the ambient pressure, in particular for creating a substantially vacuum condition inside the chamber, so that the chamber has a lower volume in a grip condition of said at least one housing and gripping element as compared to a volume that said chamber has in a rest condition of said at least one housing and gripping element.

15. The mover device according to claim 14, wherein said inner chamber has a plurality of deformable elements arranged internally thereto, said deformable elements being configured for getting deformed to grip said parts and/or joints of said patient's body in a grip condition of said at least one housing and gripping element.

16. The mover device according to claim 9, wherein said chamber contains materials, configured for:

being electrically and/or chemically and/or thermally energized, changing their own shape in the electrical and/or chemical and/or thermal energization condition, the electrical and/or chemical and/or thermal energization of said materials determining a transition of said at least one housing and gripping element from a rest condition to a grip condition, the electro-active materials changing their own shape thus making it possible for said at least one housing and gripping element to grip parts and/or joints of said patient's body.

17. The mover device according to claim 1, also comprising a garment, configured for being worn by said patient, said at least one housing and gripping element being integrated in said garment in correspondence with at least one portion of the garment intended for being put, in conditions of use of said garment wherein the garment is worn by said patient, in correspondence with or in proximity of or around parts and/or joints of said patient's body.

18. A method for moving patients and/or persons with reduced mobility comprising:

providing the mover device according to claim 1;

engaging said at least one housing and gripping element with a part and/or joint of said patient's body so as to effect a transition of said at least one housing and gripping element from a rest condition to a grip condition;

connecting at least one of said plurality of support elements, cables, belts, or elongate traction elements to said at least one housing and gripping element so as to firmly engage and render said at least one housing and gripping element integral with said support element, cable, belt, or elongate traction element; and operating, by way of said control unit, said at least one support element, cable, belt, or elongate traction element so as to make it possible to move, and in particular to at least lift and/or change the position of or at least partially re-positioning the part and/or joint of a patient's body engaged by said at least one housing and gripping element with respect to said health and/or medical and/or domestic and/or orthopedic installation, or with respect to a further health and/or medical and/or domestic and/or orthopedic installation arranged in proximity of said health and/or medical and/or domestic and/or orthopedic installation.

19. The method according to claim 18, also comprising the step of stimulating or energizing said inner chamber so as to increase or decrease a volume and/or an internal pressure of said chamber and/or to deform and/or make said inner chamber change its shape.

20. The method according to claim 18, also comprising a step of energizing said at least one housing and gripping element so as to make an external circumference thereof increase or decrease in order to exert a given pressure onto said part and/or joint of said patient's body.

21. A mover device for the body of patients and/or persons with reduced mobility, suitable and configured for being operationally positioned above or close to a health and/or medical and/or domestic and/or orthopedic installation, be it movable or fixed, the mover device comprising:

a frame comprising a binding portion configured for positioning said mover device in a stable equilibrium above or close to said health and/or medical and/or domestic and/or orthopedic installation;

a motor-driven operating portion, supported by said frame on an upper surface or portion of the frame and at least partially overhanging, or arranged close to said health and/or medical and/or domestic and/or orthopedic installation, said motor-driven operating portion comprising a plurality of support elements, cables, belts, or elongate traction elements, each support element, cable, belt, or elongate traction element being movable according to at least one degree of freedom and/or along at least one axis in the space and being configured for:

at least partially or fully supporting the weight of a patient, being moved, in particular translationally and/or rotationally, moving at least one respective part of the patient's body according to said at least one degree of freedom and/or along said at least one axis with respect to said health and/or medical and/or domestic and/or orthopedic installation, and/or moving parts of said patient's body in order to at least partially modify the position of the patient in the space and/or to make parts of the patient's body get closer to the health and/or medical and/or domestic and/or orthopedic installation and/or to make them move away from the health and/or medical and/or domestic and/or orthopedic installation;

a control unit configured for controlling and/or programming the movements of one or more of said plurality of said support elements, cables, belts, or elongate traction elements so as to make it possible to move, and in particular to at least lift and/or change the position of or to at least partially reposition parts of the patient's body or the patient himself/herself with respect to said health and/or medical and/or domestic and/or orthopedic installation, or with respect to a further health and/or medical and/or domestic and/or orthopedic installation arranged in proximity of said health and/or medical and/or domestic and/or orthopedic installation;

an operating element supported by the frame and configured for at least rotating with respect to the frame co-planar with respect to said upper surface or portion of the frame or in a plane parallel to said upper surface or portion of the frame, the support elements, cables, belts, or elongate traction elements being rotationally integral with and engaging, either directly or indirectly, said support elements, cables, belts, or elongate traction elements to rotate integrally with the operating element; and one or several support cross-members supported by said operating element, each support cross-member featuring a main direction of development, at least one support element, cable, belt, or elongate traction element movably engaging a respective support cross-member so as to be able to translationally move at least along the main direction of development of said support cross-member; and two arms mounted on a support cross-member, either directly or indirectly by way of an intermediate connection element slidable along said support cross-member, said arms being configured for rotating and/or moving translationally with respect to said support cross-member.

* * * * *